US009513592B2

(12) United States Patent
Akiyama et al.

(10) Patent No.: US 9,513,592 B2
(45) Date of Patent: Dec. 6, 2016

(54) HEATER, IMAGE HEATING APPARATUS INCLUDING THE HEATER AND MANUFACTURING METHOD OF THE HEATER

(71) Applicant: CANON KABUSHIKI KAISHA, Tokyo (JP)

(72) Inventors: Naoki Akiyama, Toride (JP); Toshinori Nakayama, Kashiwa (JP); Masayuki Tamaki, Abiko (JP); Shigeaki Takada, Abiko (JP); Akeshi Asaka, Kashiwa (JP); Koichi Kakubari, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/844,249

(22) Filed: Sep. 3, 2015

(65) Prior Publication Data

US 2016/0070225 A1 Mar. 10, 2016

(30) Foreign Application Priority Data

Sep. 9, 2014 (JP) ..... 2014-183707

(51) Int. Cl.
*G03G 15/20* (2006.01)
*G03G 15/00* (2006.01)
(Continued)

(52) U.S. Cl.
CPC ..... *G03G 15/80* (2013.01); *G03G 15/2042* (2013.01); *G03G 15/2053* (2013.01);
(Continued)

(58) Field of Classification Search
CPC G03G 15/80; G03G 15/2042; G03G 15/2053; G03G 15/2082; H01C 17/06; H01C 17/28; H01C 17/283; H05B 1/0241; H05B 3/20; H05B 3/24
See application file for complete search history.

(56) References Cited

U.S. PATENT DOCUMENTS 5,171,969 A 12/1992 Nishimura et al.
5,285,049 A 2/1994 Fukumoto et al.
(Continued)

FOREIGN PATENT DOCUMENTS

EP 0426072 A2 5/1991
JP 5-29066 A 2/1993
(Continued)

OTHER PUBLICATIONS

U.S. Appl. No. 14/718,557, filed May 21, 2015.
(Continued)

*Primary Examiner* — Erika J Villaluna
(74) *Attorney, Agent, or Firm* — Fitzpatrick, Cella, Harper & Scinto

(57) ABSTRACT

A heater includes a substrate, a first electrical contact, a plurality of second electrical contacts, a plurality of electrode portions including first electrode portions electrically connected with the first electrical contact and second electrode portions electrically connected with the second electrical contacts, the first electrode portions and the second electrode portions being arranged alternately with predetermined gaps in a longitudinal direction of the substrate, and a plurality of heat generating portions provided between adjacent ones of the electrode portions so as to electrically connect between adjacent electrode portion. The heat generating portions are capable of generating heat by the electric power supply between adjacent electrode portions. A part of the second electrical contacts is selectably electrically connectable with the second terminal. The electrode portions are covered with the heat generating portions so as to be positioned between the substrate and the heat generating portions.

8 Claims, 17 Drawing Sheets

(51) Int. Cl.

| | |
|---|---|
| ***H05B 1/02*** | (2006.01) |
| ***H05B 3/24*** | (2006.01) |
| ***H01C 17/06*** | (2006.01) |
| ***H01C 17/28*** | (2006.01) |

(52) U.S. Cl.

CPC ..... *H01C 17/06* (2013.01); *H01C 17/28* (2013.01); *H05B 1/0241* (2013.01); *H05B 3/24* (2013.01); *G03G 2215/2035* (2013.01)

(56) References Cited

U.S. PATENT DOCUMENTS

| | | | |
|---|---|---|---|
| 5,376,773 | A | 12/1994 | Masuda et al. |
| 7,200,354 | B2 | 4/2007 | Nakamoto et al. |
| 7,260,351 | B2 | 8/2007 | Nakayama |
| 7,263,303 | B2 | 8/2007 | Nakayama |
| 7,343,130 | B2 | 3/2008 | Nakayama |
| 7,430,392 | B2 | 9/2008 | Ito et al. |
| 7,457,576 | B2 | 11/2008 | Takada et al. |
| 7,460,821 | B2 | 12/2008 | Ai et al. |
| 7,466,950 | B2 | 12/2008 | Matsuura et al. |
| 7,505,724 | B2 | 3/2009 | Nakayama |
| 7,590,366 | B2 | 9/2009 | Nakayama |
| 7,596,348 | B2 | 9/2009 | Nakamoto et al. |
| 7,729,628 | B2 | 6/2010 | Nakayama |
| 7,844,208 | B2 | 11/2010 | Hayashi et al. |
| 7,907,861 | B2 | 3/2011 | Nakayama |
| 8,145,086 | B2 | 3/2012 | Chiyoda et al. |
| 8,301,067 | B2 | 10/2012 | Takada |
| 8,306,446 | B2 | 11/2012 | Ito et al. |
| 8,559,837 | B2 | 10/2013 | Nakayama |
| 8,712,271 | B2 | 4/2014 | Nakayama et al. |
| 8,750,739 | B2 | 6/2014 | Tamaki et al. |
| 8,818,222 | B2 | 8/2014 | Tamaki |
| 8,867,941 | B2 | 10/2014 | Takada |
| 8,913,936 | B2 | 12/2014 | Takada et al. |
| 8,917,999 | B2 | 12/2014 | Takada et al. |
| 8,918,003 | B2 | 12/2014 | Kawai et al. |
| 8,929,762 | B2 | 1/2015 | Shinagawa et al. |
| 8,989,640 | B2 | 3/2015 | Kitagawa et al. |
| 2011/0082260 | A1 | 4/2011 | Omata et al. |
| 2012/0224876 | A1 | 9/2012 | Nakayama et al. |
| 2013/0142532 | A1 | 6/2013 | Kitagawa et al. |
| 2013/0206745 | A1 | 8/2013 | Tanaka et al. |
| 2013/0299480 | A1 | 11/2013 | Kakubari et al. |
| 2013/0322897 | A1 | 12/2013 | Yago et al. |
| 2014/0076878 | A1* | 3/2014 | Shimura ..... G03G 15/2042 219/216 |
| 2014/0105658 | A1 | 4/2014 | Tamaki |
| 2014/0112692 | A1 | 4/2014 | Omata et al. |
| 2014/0353303 | A1 | 12/2014 | Fudo et al. |
| 2015/0212473 | A1 | 7/2015 | Kitagawa et al. |

FOREIGN PATENT DOCUMENTS

| | | | |
|---|---|---|---|
| JP | 6-250539 | A | 9/1994 |
| JP | 8-55671 | A | 2/1996 |
| JP | 8-185069 | A | 7/1996 |
| JP | 08185069 | A * | 7/1996 |
| JP | 2012-037613 | A | 2/2012 |
| JP | 2014-235315 | A | 12/2014 |

OTHER PUBLICATIONS

U.S. Appl. No. 14/794,869, filed Jul. 9, 2015.
U.S. Appl. No. 14/718,672, filed May 21, 2015.
U.S. Appl. No. 14/719,497, filed May 22, 2015.
U.S. Appl. No. 14/719,474, filed May 22, 2015.
U.S. Appl. No. 14/799,056, filed Jul. 14, 2015.
U.S. Appl. No. 14/799,123, filed Jul. 14, 2015.
U.S. Appl. No. 14/857,086, filed Sep. 17, 2015.
EP Communication and Search Report mailed Mar. 1, 2016, issued in counterpart European Patent Application No. 15182297.0.

* cited by examiner

HEATER, IMAGE HEATING APPARATUS INCLUDING THE HEATER AND MANUFACTURING METHOD OF THE HEATER

FIELD OF THE INVENTION AND RELATED ART

The present invention relates to a heater for heating an image on a sheet, an image heating apparatus including the heater and a manufacturing method of the heater. The image heating apparatus is usable with an image forming apparatus such as a copying machine, a printer, a facsimile machine, a multifunction machine having a plurality of functions thereof or the like.

An image forming apparatus is known in which a toner image is formed on the sheet and is fixed on the sheet by heat and pressure in a fixing device (image heating apparatus). As for such a fixing device, a type of fixing device is proposed (Japanese Laid-open Patent Application (JP-A) Hei 6-250539) in which a heat generating element (heater) is contacted to an inner surface of a thin flexible belt to apply heat to the belt. Such a fixing device is advantageous in that the structure has a low thermal capacity, and therefore, the temperature rise to the temperature permitting the performing of the fixing operation is quick.

JPA Hei 6-250539 discloses a structure of a heater including a plurality of electrodes arranged, in a longitudinal direction of a substrate, on a heat generating element (heat generating member) extending in the longitudinal direction. On this heater, the electrodes different in polarity are alternately arranged on the heat generating element, and therefore a current flows through the heat generating elements between adjacent electrodes. Specifically, the electrodes of one polarity are connected with electroconductive lines provided in one widthwise end side of the substrate relative to the heat generating element, and the electrodes of the other polarity are connected with electroconductive lines provided in the other widthwise end side of the substrate relative to the heat generating element. For this reason, when a voltage is applied between these electroconductive lines, the heat generating elements generate heat in an entire region thereof with respect to the longitudinal direction.

Incidentally, the manner of the heat generation of the heat is determined by a resistance of the heat generating element and the magnitude of a current flowing through the heat generating element. The resistance of the heat generating element is determined by a dimension and a value of the resistivity of the heat generating element. In JP-A Hei 6-250539, the heater is caused to generate heat in a desired manner by adjusting the resistance of the heat generating element with respect to an energization direction by a gap between the adjacent electrodes.

However, the heater disclosed in JP-A Hei 6-250539 is susceptible to improvement in terms of durability. The heater disclosed in JP-A Hei 6-250539 has a structure in which the electrodes are laminated on the heat generating element and lower surfaces of the electrodes are connected with the heat generating element. Further, in this heater, between the adjacent electrodes with the gap, the current flows along the longitudinal direction of the heat generating element. The current has such a property that the current tends to flow along a shortest path, and therefore when energization to the heat is made, the current concentratedly flows from an end portion of the electrode toward the heat generating element. Then, by the concentrated current, a part of the heat generating element is locally in an over-heat state, so that the degree of deterioration is accelerated at this part more than another portion. For that reason, the life of the heat decreases.

SUMMARY OF THE INVENTION

A principal object of the present invention is to provide a heater whose tendency to shorten its lifespan is suppressed.

Another object of the present invention is to provide an image heating apparatus including a heater whose tendency to shorten its lifespan is suppressed.

A further object of the present invention is to provide a manufacturing method of a heater whose tendency to shorten its lifespan is suppressed.

According to an aspect of the present invention, there is provided a heater usable with an image heating apparatus including an electric energy supplying portion provided with a first terminal and a second terminal, and an endless belt for heating an image on a sheet. The heater is contactable to the belt to heat the belt. The heater comprises: a substrate; a first electrical contact provided on the substrate and electrically connectable with the first terminal; a plurality of second electrical contacts provided on the substrate and electrically connectable with the second terminal; a plurality of electrode portions including first electrode portions electrically connected with the first electrical contact and second electrode portions electrically connected with the second electrical contacts, the first electrode portions and the second electrode portions being arranged alternately with predetermined gaps in a longitudinal direction of the substrate; and a plurality of heat generating portions provided between adjacent ones of the electrode portions so as to electrically connect between adjacent electrode portions, the heat generating portions being capable of generating heat by the electric power supply between adjacent electrode portions. A part of the second electrical contacts is selectably electrically connectable with the second terminal, and the electrode portions are covered with the heat generating portions so as to be positioned between the substrate and the heat generating portions.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called a printer.

Embodiment 1

Image Forming Portion

Figure 1:
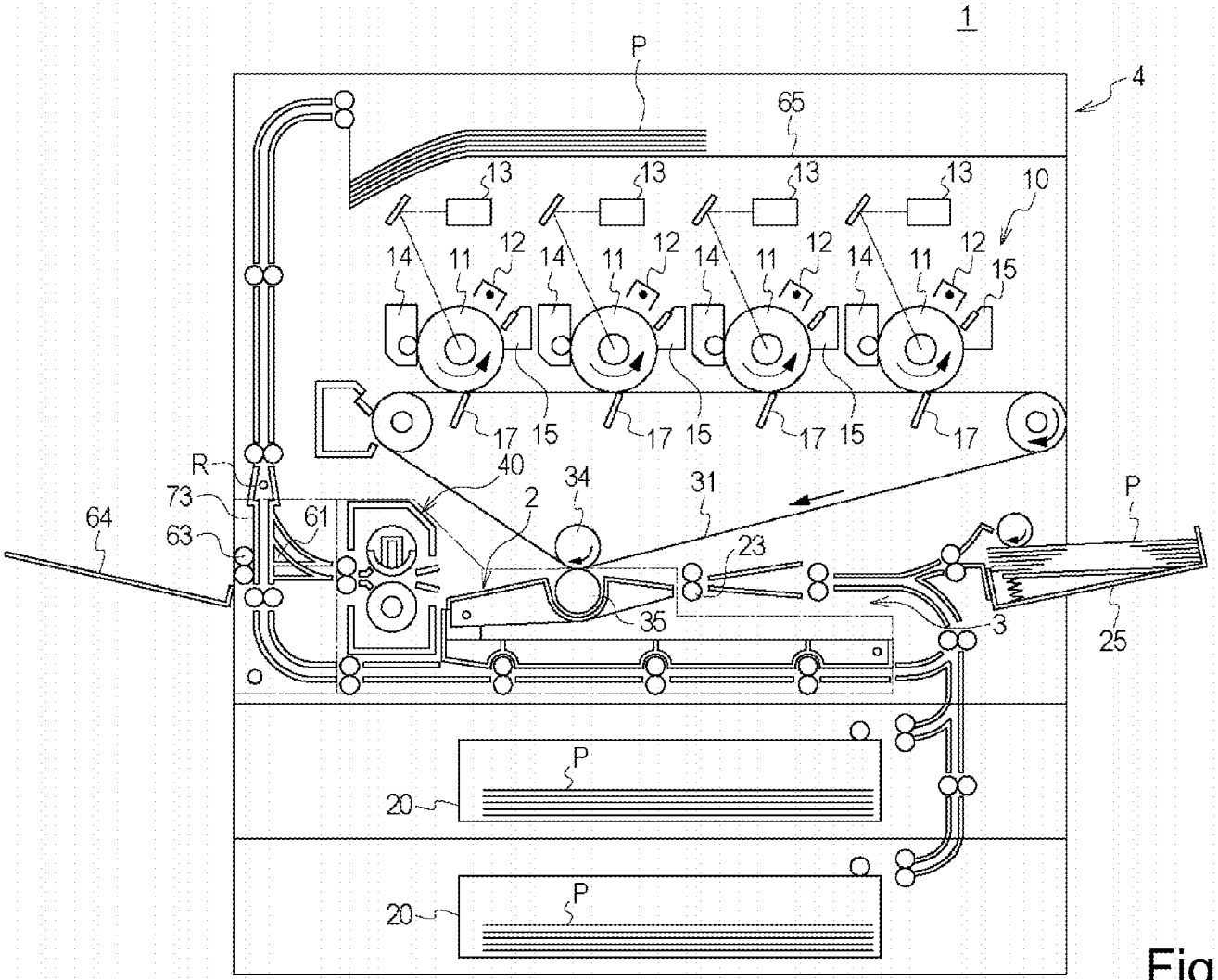
FIG. 1 is a sectional view of an image forming apparatus according to Embodiment 1 of the present invention.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and Bk (black). The image forming stations 10 includes respective photosensitive drums 11 corresponding to Y, M, C, Bk colors are arranged in the order named from the left side. Around each drum 11, similar elements are provided as follows: a charger 12; an exposure device 13; a developing device 14; a primary transfer blade 17; and a cleaner 15. The structure for the Bk toner image formation will be described as a representative example, and the descriptions for the other colors are omitted for simplicity by assigning the like reference numerals. So, the elements will be simply called a photosensitive drum 11, a charger 12, an exposure device 13, a developing device 14, a primary transfer blade 17 and a cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 or placed on a multi-feeding tray 25 is picked up by a feeding mechanism (unshown) and fed to a pair of registration rollers 23. The sheet P is a member on which the image is formed. Specific examples of the sheet P is plain paper, thick sheet, resin material sheet, overhead projector film or the like. The pair of registration rollers 23 once stops the sheet P for correcting oblique feeding. The registration rollers 23 then feed the sheet P into between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
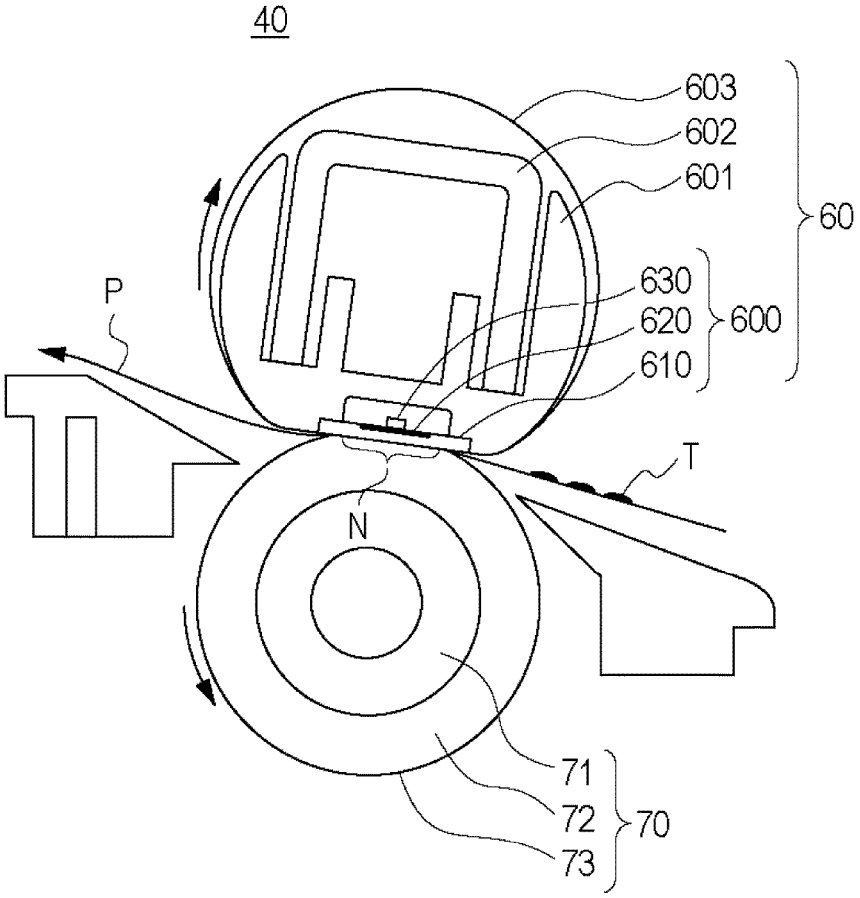
FIG. 2 is a sectional view of an image heating apparatus according to Embodiment 1.
Figure 3:
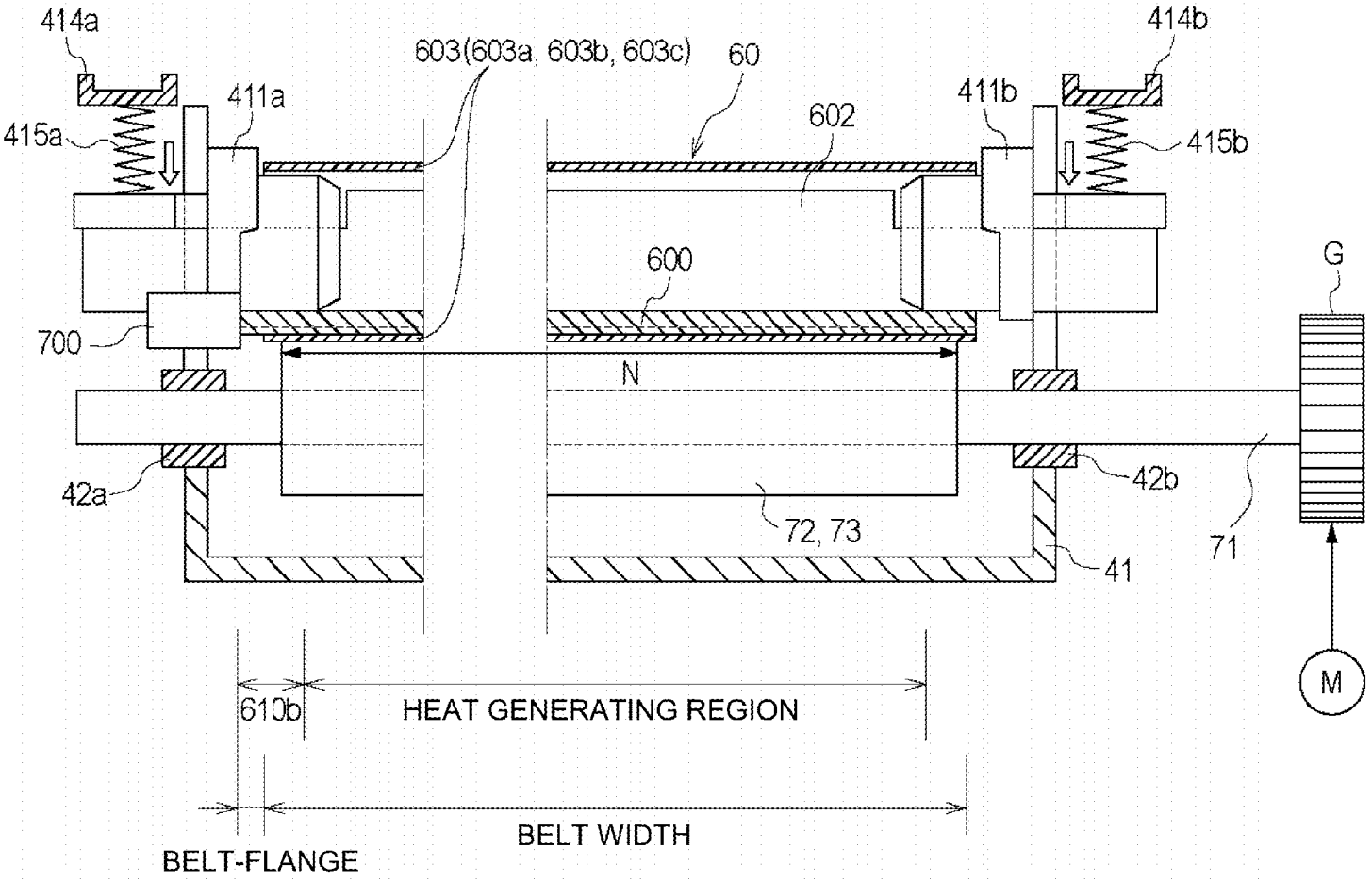
FIG. 3 is a front view of the image heating apparatus according to Embodiment 1.
Figure 4:
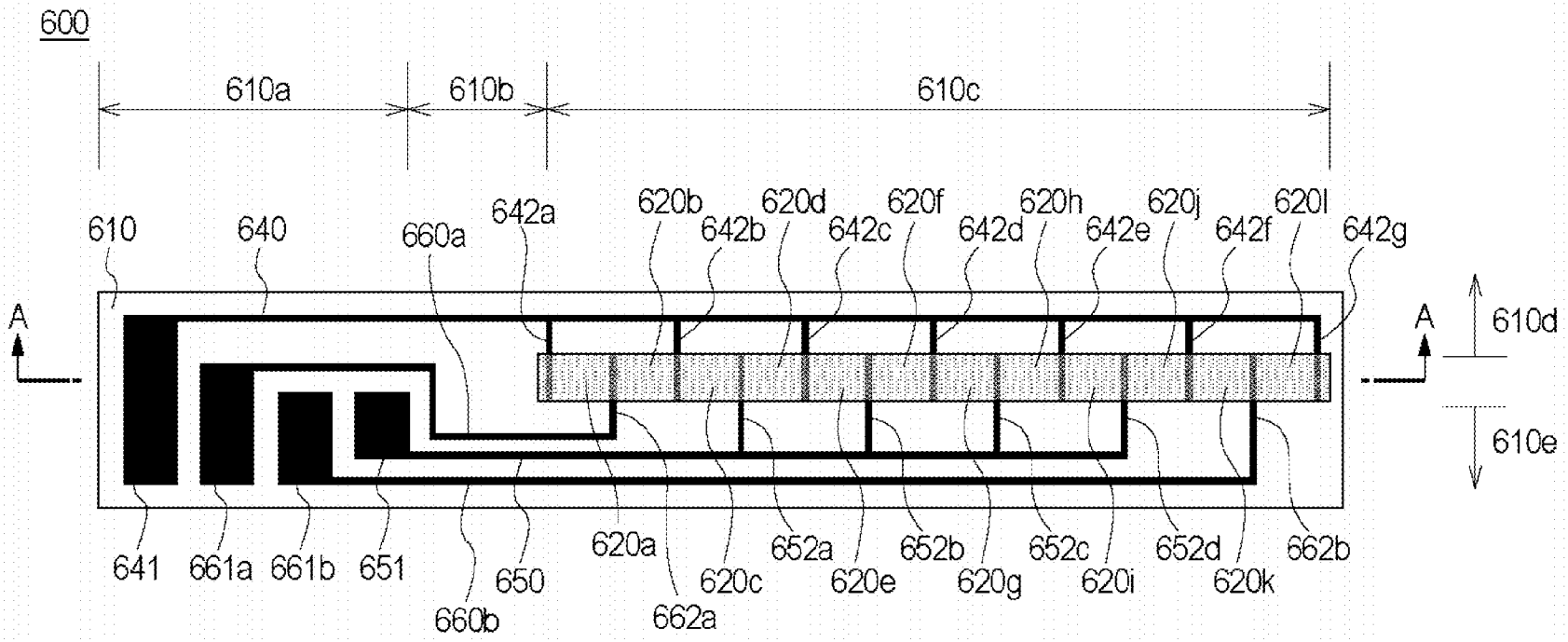
FIG. 4 illustrates a structure of a heater according to Embodiment 1.
Figure 5:
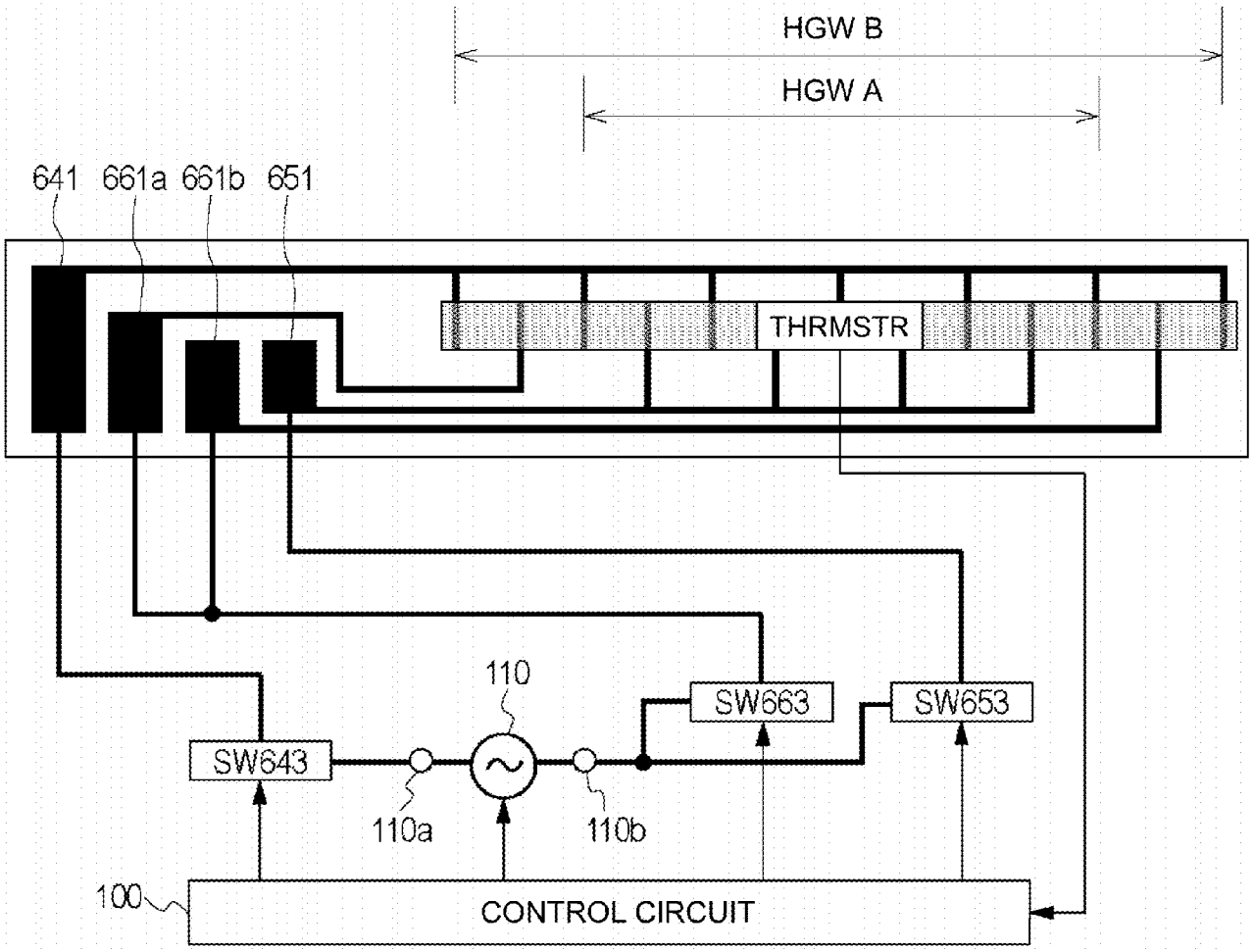
FIG. 5 illustrates a structural relationship of the image heating apparatus according to Embodiment 1.

The fixing device 40, which is the image heating apparatus used in the printer 1, will be described. FIG. 2 is a sectional view of the fixing device 40. FIG. 3 is a front view of the fixing device 40. FIG. 4 illustrates a structure of a heater 600. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and the heater 600 as a heating member contacted to the inner surface of the belt 603 to heat the belt 603 (low thermal capacity structure). Therefore, the belt 603 can be efficiently heated, so that quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. The longitudinal direction of the unit 60 is parallel with the longitudinal direction of the roller 70. The unit 60 comprises a heater 600, a heater holder 601, a support stay 602 and a belt 603.

The heater 600 is a plate-like heating member for heating the belt 603, slidably contacting the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the up-down direction in FIG. 4), 350-400 mm in the length (the dimension as measured in the left-right direction in FIG. 4), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620) functioning as a heat generating layer.

The heater 600 is fixed on the lower surface of the heater holder 601 along the longitudinal direction of the heater holder 601. In this embodiment, the heat generating element 620 is provided on the back side of the substrate 610, which is not in slidable contact with the belt 603, but the heat generating element 620 may be provided on the front surface of the substrate 610, is in slidable contact with the belt 603. However, the heat generating element 620 of the heater 600 is preferably provided on the back side of the substrate 610, by which a uniform heating effect to the substrate 610 is accomplished, from the standpoint of preventing non-uniform heat application to the belt 603. The details of the heater 600 will be described hereinafter.

The heater 600 is fixed along the longitudinal direction of the heater holder 601 on a lower surface of the heater holder 601. In this embodiment, the heat generating element 620 is provided in a back surface side (in a side where the heat generating element 620 does not slide with the belt 603) of the substrate 610, but may also be provided in the front surface side (in a side where the heat generating element 620 slides with the belt 603) of the substrate 610. However, in order to prevent generation of non-uniformity of heat supplied to the belt 603 by a non-heat generating portion of the heat generating element 620, it is desirable that the heat generating element 620 is provided in the back surface side, of the substrate 610, where a heat-uniformizing effect of the substrate 610 can be obtained. Details of the heater 600 will be described later.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of 30 mm in the outer diameter, 330 mm in the length (the dimension measured in the front-rear direction in FIG. 2), 30 μm in the thickness, and the material of the base material 603*a* is nickel. The silicone rubber elastic layer 603*b* having a thickness of 400 μm is formed on the base material 603*a*, and a fluorine resin tube (parting layer 603*c*) having a thickness of 20 μm coats the elastic layer 603*b*. The belt contacting surface of the substrate 610 may be provided with a polyimide layer having a thickness of 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface of FIG. 2) and functions to regulate a rotation orbit of the belt 603. The holder 601 may be made of heat resistive resin material or the like. In this embodiment, it is Zenite 7755 (tradename) available from Dupont.

The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called the urging spring 415. With such a structure, the elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is 156.8 N (16 kgf) at one end portion side and 313.6 N (32 kgf) in total.

As shown in FIG. 3, a connector 700 is provided as an electric energy supply member electrically connected with the heater 600 to supply the electric power to the heater 600. The connector 700 is detachably provided at one longitudinal end portion of the heater 600. The connector 700 is easily detachably mounted to the heater 600, and therefore, assembling of the fixing device 40 and the exchange of the heater 600 or belt 603 upon damage of the heater 600 is easy, thus a providing good maintenance property.

As shown in FIG. 2, the roller 70 is a nip forming member which contacts an outer surface of the belt 603 to cooperate with the belt 603 to form the nip N. The roller 70 has a multi-layer structure on a metal core 71 composed of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core 71 of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are 25 mm in outer diameter, and 330 mm in length.

A thermistor 630 is a temperature sensor provided on a back side of the heater 600 (opposite side from the sliding surface side. The thermistor 630 is bonded to the heater 600 in the state that it is insulated from the heat generating element 620. The thermistor 630 has a function of detecting a temperature of the heater 600. As shown in FIG. 5, the thermistor 630 is connected with a control circuit 100 through an A/D converter (unshown) and feed an output corresponding to the detected temperature to the control circuit 100.

The control circuit 100 comprises a circuit including a CPU operating for various controls, a non-volatilization medium such as a ROM storing various programs. The programs are stored in the ROM, and the CPU reads and execute them to effect the various controls. The control circuit 100 may be an integrated circuit such as ASIC if it is capable of performing a similar operation.

As shown in FIG. 5, the control circuit 100 is electrically connected with the voltage source 110 so as to control electric power supply from the voltage source 110. The control circuit 100 is electrically connected with the thermistor 630 to receive the output of the thermistor 630.

The control circuit 100 uses the temperature information acquired from the thermistor 630 for the electric power supply control for the voltage source 110. More particularly, the control circuit 100 controls the electric power to the heater 600 through the voltage source 110 on the basis of the output of the thermistor 630. In this embodiment, the control circuit 100 carries out a wave number control of the output of the voltage source 110 to adjust an amount of heat generation of the heater 600. By such a control, the heater 600 is maintained at a predetermined temperature (180 degree C., for example).

As shown in FIG. 3, the metal core 71 of the roller 70 is rotatably held by bearings 41*a* and 41*b* provided in a rear side and a front side of the side plate 41, respectively. One axial end of the metal core 71 is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving means for driving the roller 70 through the gear G. The control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (200 [mm/sec], for example).

[Heater]

Figure 6:
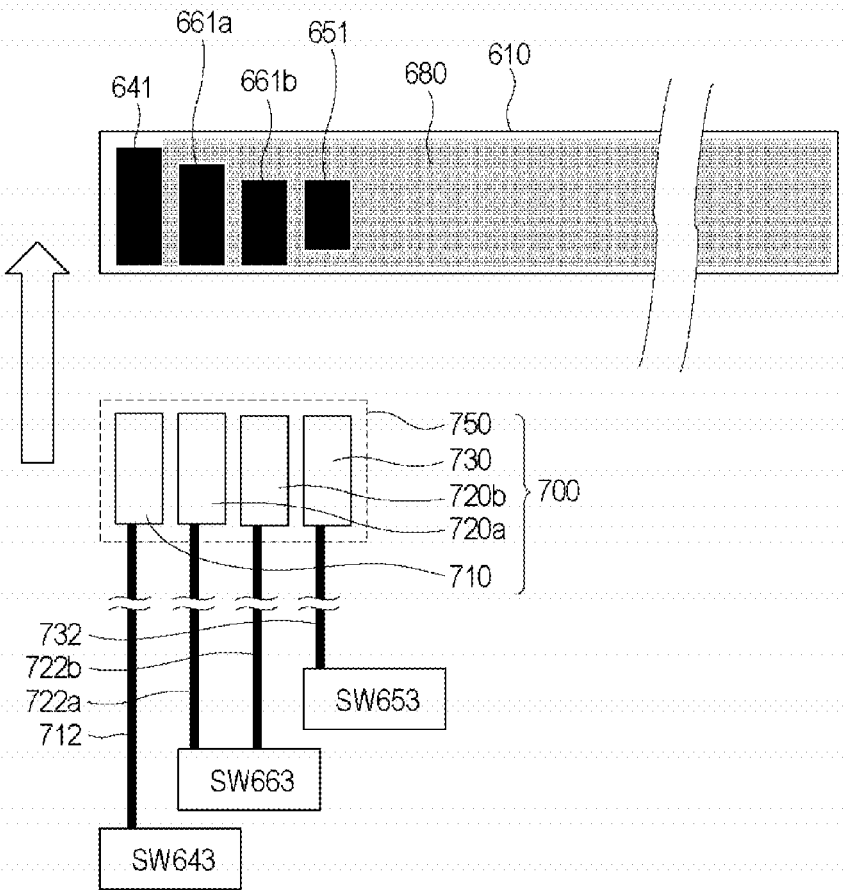
FIG. 6 illustrates a connector.
Figure 8:
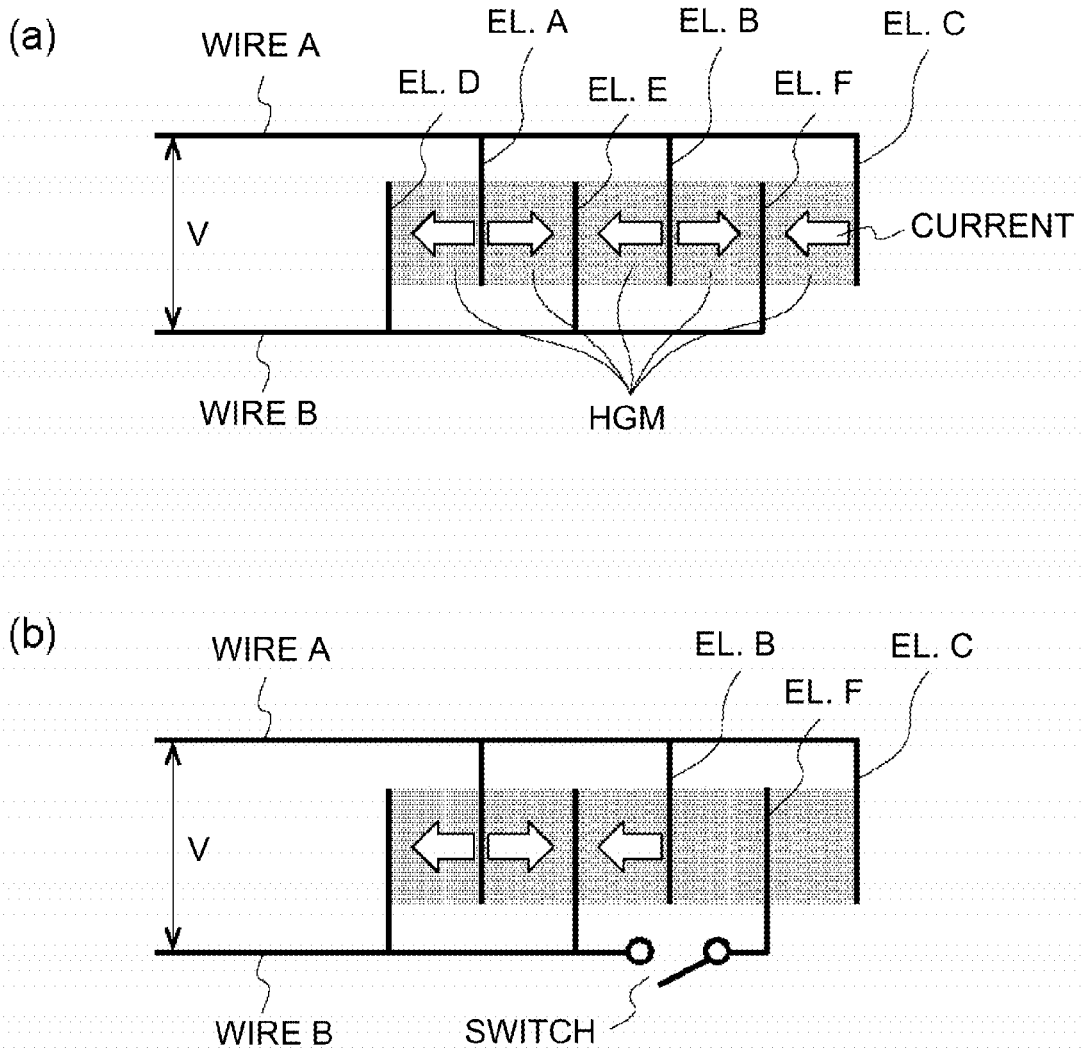
In FIG. 8, (*a*) illustrates a heat generating type for a heater, and (*b*) illustrates a switching system for a heat generating region of the heater.

The structure of the heater 600 used in the fixing device 40 will be described in detail. FIG. 6 illustrates a connector 700. In FIG. 8, (*a*) illustrates a heat generating type used in the heater 600, and (*b*) illustrates a heat generating region switching type used with the heater 600.

The heater 600 of this embodiment is a heater using the heat generating type shown in (*a*) and (*b*) of FIG. 8. As shown in (*a*) of FIG. 8, electrodes A-C are electrically connected with A-electroconductive-line ("WIRE A"), and electrodes D-F are electrically connected with B-electroconductive-line ("WIRE B"). The electrodes connected with the A-electroconductive-lines and the electrodes connected with the B-electroconductive-lines are interlaced (alternately arranged) along the longitudinal direction (left-right direction in (*a*) of FIG. 8), and heat generating elements are electrically connected between the adjacent electrodes. The electrodes and the electroconductive lines are electroconductor patterns (lead wires) formed in a similar manner. In this embodiment, the lead wire contacted to and electrically connected with the heat generating element is referred to as the electrode, and the lead wire performing the function of connecting a portion, to which the voltage is applied, with the electrode is referred to as the electroconductive line (electric power supplying line). When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type heater, the heat is generated in the above-described the manner. As shown in (*b*) of FIG. 8, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing switch or the like in the electroconductive line. In the heater 600, the heat generating region of the heat generating element 620 can be changed using the above-described system.

In the case that the electric power is supplied individually to the heat generating elements arranged in the longitudinal direction, it is preferable that the electrodes and the heat generating elements are disposed such that the directions of the electric current flow alternates between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of short circuit. In addition, the number of required electrodes is large with the result of large non-heat generating portion between the heat generating elements. Therefore, it is preferable to arrange the heat generating elements and the electrodes such that an electrode is made common between adjacent heat generating elements. With such an arrangement, the likelihood of the short circuit between the electrodes can be avoided, and a space between the electrodes can be eliminated.

In this embodiment, a common electroconductive line 640 shown in FIG. 4 corresponds to A-electroconductive-line of (*a*) of FIG. 8, and opposite electroconductive lines 650, 660*a*, 660*b* (FIG. 4) correspond to B-electroconductive-line ((*a*) of FIG. 8). In addition, common electrodes 642*a*-642*g* as a first electrode layer (FIG. 4) correspond to electrodes A-C ((*a*) of FIG. 8), and opposite electrodes 652*a*-652*d*, 662*a*, 662*b* as a second electrode layer (FIG. 4) correspond to electrodes D-F ((*a*) of FIG. 8). Heat generating elements 620*a*-620*l* (FIG. 4) correspond to the heat generating elements of (*a*) of FIG. 8. Hereinafter, the common electrodes 642*a*-642*g* are simply common electrode 642. The opposite electrodes 652*a*-652*d* are simply called opposite electrode 652. The opposite electrodes 662*a*, 662*b* are simply called opposite electrode 662. The opposite electroconductive lines 660*a*, 660*b* are simply called opposite electroconductive line 660. The heat generating elements 620*a*-620*l* are simply called heat generating element 620. The structure of the heater 600 will be described in detail referring to the accompanying drawings.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of 400 mm, a width (up-down direction in FIG. 4) of 10 mm and a thickness of 1 mm. The alumina plate member is 30 W/m·K in thermal conductivity.

Figure 9:
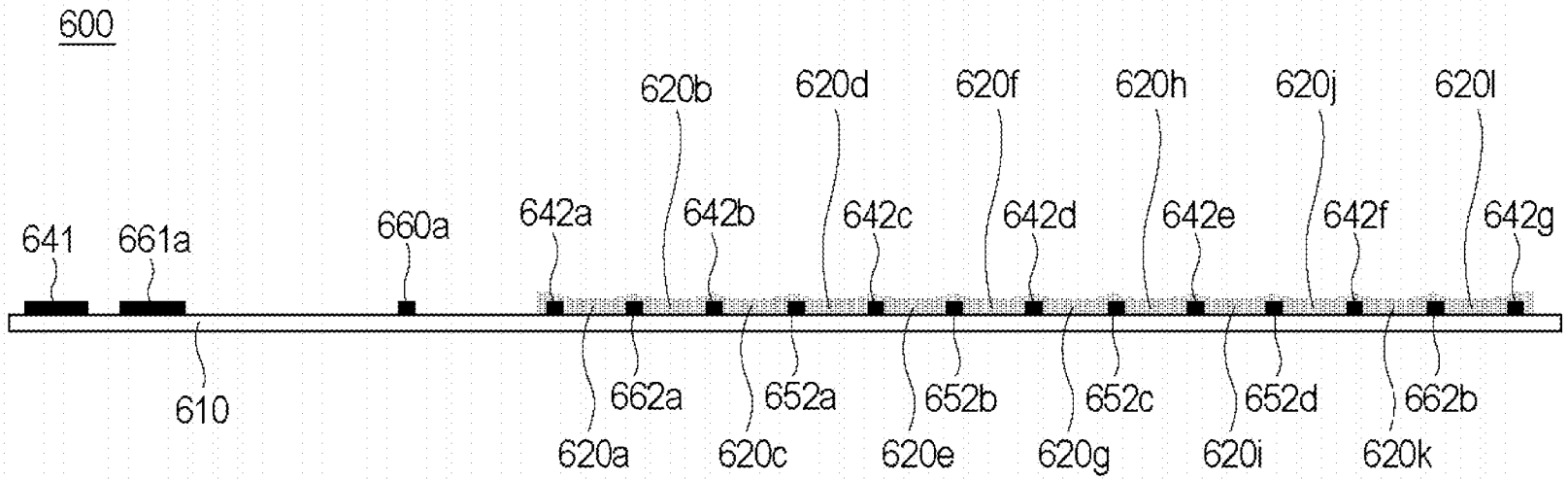
FIG. 9 is a sectional view of the heater in Embodiment 1.

FIG. 9 is a sectional view, taken along A-A line (FIG. 4), of a portion where the heat generating element 620, the common electrode 642 and the opposite electrodes 652 and 662 overlap with each other. On the back surface of the substrate 610, the heat generating element 620 and the electroconductor pattern (including the common electrode 642 and the opposite electrodes 652 and 662) are provided through thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. Each of the common electrode 642 and the opposite electrodes 652 and 662 is 20-50 μm in width and 5-30 μm in thickness. In this embodiment, each of the electrodes was formed of 100 μm in width and 10 μm in thickness. Accordingly, the resistivity of the heat generating element 620 is sufficiently larger than the resistivity of each of the electrodes 642, 642, 662.

A layer structure will be described using FIG. 9. On the substrate 610, the common electrodes 642 (642*a*-642*g*) and the opposite electrodes 652 (652*a*-652*d*) and 662 (662*a*, 662*b*) and formed, and then the heat generating elements 620 (620*a*-620*l*) are formed between and above the common electrodes and the opposite electrodes. In summary, the common electrodes 642 and the opposite electrodes 652 and 662 are covered with the heat generating element 620.

As shown in FIG. 6, the heat generating element 620 and the electroconductor pattern are coated with the insulation coating layer 680 of heat resistive glass so that they are electrically protected from leakage and short circuit. For that reason, in this embodiment, a gap between adjacent electroconductive lines can be provided narrowly. However, the insulation coating layer 680 is not necessarily provided on the heater 600. For example, by providing the adjacent electroconductive lines with a large gap, it is possible to prevent short circuit between the adjacent electroconductive lines. However, it is desirable that a constitution in which the insulation coating layer 680 is provided from the viewpoint that the heater 600 can be downsized.

As shown in FIG. 4, there are provided electrical contacts 641, 651, 661*a*, 661*b* as a part of the electroconductor pattern in one end portion side 610*a* of the substrate 610 with respect to the longitudinal direction. In addition, there are provided the heat generating element 620 common electrodes 642*a*-642*g* and opposite electrodes 652*a*-652*d*, 662*a*, 662*b* as a part of the electroconductor pattern in the other end portion side 610*c* of the substrate 610 with respect to the longitudinal direction of the substrate 610. Between the one end portion side 610*a* of the substrate and the other end portion side 610*c*, there is a middle region 610*b*. In one end portion side 610*d* of substrate 610 beyond the heat generating element 620 with respect to the widthwise direction, the common electroconductive line 640 as a part of the electroconductor pattern is provided. In the other end portion side 610*e* of the substrate 610 beyond the heat generating element 620 with respect to the widthwise direction, the opposite electroconductive lines 650 and 660 are provided as a part of the electroconductor pattern.

The heat generating element 620 (620*a*-620*l*) is a resistor capable of generating joule heat by electric power supply (energization). The heat generating element 620 is one heat generating element member extending in the longitudinal direction on the substrate 610, and is disposed in a region 610*c* (FIG. 4) in the neighborhood of a substantially central portion of the substrate 610. The dimension of the heat generating element 620 is adjusted in a range of a width (measured in the widthwise direction of the substrate 610) of 1-4 mm and a thickness of 5-20 μm so as to provide a desired resistance value. The heat generating element 620 in this embodiment has the width of 2 mm and the thickness of 10 μm. A total length of the heat generating element 620 in the longitudinal direction is 320 mm, which is enough to cover a width of the A4 size sheet P (297 mm in width).

The heat generating element 620 is laminated on seven common electrodes 642*a*-642*g* arranged in the longitudinal direction of the substrate 610. In other words, a heat generating region of the heat generating element 620 is isolated into six sections by common electrodes 642*a*-642*g* along the longitudinal direction. The lengths measured in the longitudinal direction of the substrate 610 of each section are 53.3 mm. On central portions of the respective sections of the heat generating element 620, one of the six opposite electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements (resistance elements) 620*a*-620*l*. In other words, the heat generating elements 620*a*-620*l* electrically connect adjacent electrodes with each other. Lengths of the sub-section measured in the longitudinal direction of the substrate 610 are 26.7 mm. Resistance values of the sub-section of the heat generating element 620 with respect to the longitudinal direction are 120Ω. With such a structure, the heat generating element 620 is capable of generating heat in a partial area or areas with respect to the longitudinal direction.

The resistances of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent local temperature lowering at the longitudinal end portions of the heat generating element 620. At the positions of the heat generating element 620 where the common electrode 642 and the opposite electrode 652, 662 are provided, the heat generation of the heat generating element 620 is substantially zero. However, there is a heat-uniformizing action of the substrate 610, and therefore by suppressing the thickness of the electrode to less than 1 mm, the influence on the fixing process is a negligible degree. In this embodiment, the thickness of each of the electrodes is less than 1 mm.

The common electrodes 642 (642*a*-642*g*) are a part of the above-described electroconductor pattern. The common electrode 642 extends in the widthwise direction of the substrate 610 perpendicular to the longitudinal direction of the heat generating element 620. In this embodiment, each of the common electrodes 642 is formed on the substrate 610 and is coated (covered) with the heat generating element 620. That is, the heat generating element 620 and the common electrode 642 are in a partly overlapping (laminating) positional relationship. The common electrodes 642 are odd-numbered electrodes of the plurality of electrodes connected to the heat generating element 620, as counted from a one longitudinal end of the heat generating element 620. The common electrode 642 is connected to one contact 110*a* of the voltage source 110 through the common electroconductive line 640 which will be described hereinafter. That is, the common electrode 642 is connected to a one terminal side of the voltage source 110.

The opposite electrodes 652, 662 are a part of the above-described electroconductor pattern. The opposite electrodes 652, 662 extend in the widthwise direction of the substrate 610 perpendicular to the longitudinal direction of the heat generating element 620. Each of the opposite electrodes 652, 662 is formed on the substrate 610 and is coated (covered) with the heat generating element 620. That is, the heat generating element 620 and the opposite electrodes 652, 662 are in a partly overlapping (laminating) positional relationship. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620. That is, the common electrode 642 and the opposite electrodes 662, 652 are alternately arranged along the longitudinal direction of the heat generating element. The opposite electrodes 652, 662 are connected to the other contact 110*b* of the voltage source 110 through the opposite electroconductive lines 650, 660 which will be described hereinafter. That is, the opposite electrodes 652, 662 are connected to the other terminal side of the voltage source 110.

The common electrode 642 and the opposite electrode 652, 662 function as electrode portions for supplying the electric power to the heat generating element 620. In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four maybe the opposite electrode 662.

The common electroconductive line 640 is a part of the above-described electroconductor pattern. The common electroconductive line 640 extends along the longitudinal direction of the substrate 610 toward the one end portion side 610*a* of the substrate in the one end portion side 610*d* of the substrate. The common electroconductive line 640 is connected with the common electrodes 642 (642*a*-642*g*) which is in turn connected with the heat generating element 620 (620*a*-620*l*). The common electroconductive line 640 is connected to the electrical contact 641 which will be described hereinafter. In this embodiment, the electroconductor patterns connecting the electrodes with the electrical contacts are called the electroconductive lines.

The opposite electroconductive line 650 is a part of the above-described electroconductor pattern. The opposite electroconductive line 650 extends along the longitudinal direction of substrate 610 toward the one end portion side 610*a* of the substrate 610 in the other end portion side 610*e* of the substrate. The opposite electroconductive line 650 is connected with the opposite electrodes 652 (652*a*-652*d*) which are in turn connected with heat generating elements 620 (620*c*-620*j*). The opposite electroconductive line 650 is connected to the electrical contact 651 which will be described hereinafter.

The opposite electroconductive line 660 (660*a*, 660*b*) is a part of the above-described electroconductor pattern. The opposite electroconductive line 660*a* extends along the longitudinal direction of substrate 610 toward the one end portion side 610*a* of the substrate 610 in the other end portion side 610*e* of the substrate. The opposite electroconductive line 660*a* is connected with the opposite electrode 662*a* which is in turn connected with the heat generating element 620 (620*a*, 620*b*). The opposite electroconductive line 660*a* is connected to the electrical contact 661*a* which will be described hereinafter. The opposite electroconductive line 660*b* extends along the longitudinal direction of substrate 610 toward the one end portion side 610*a* of the substrate 610 in the other end portion side 610*e* of the substrate 610. The opposite electroconductive line 660*b* is connected with the opposite electrode 662*b* which is in turn connected with the heat generating element 620. The opposite electroconductive line 660*b* is connected to the electrical contact 661*b* which will be described hereinafter.

The electrical contacts 641, 651, 661 (661*a*, 661*b*) are a part of the above-described electroconductor pattern. Each of the electrical contacts 641, 651, 661 preferably has an area of not less than 2.5 mm×2.5 mm in order to assure the reception of the electric power supply from the connector 700 which will be described hereinafter. In this embodiment, the electrical contacts 641, 651, 661 has a length of about 3 mm measured in the longitudinal direction of the substrate 610 and a width of not less than 2.5 mm measured in the widthwise direction of the substrate 610. The electrical contacts 641, 651, 661*a*, 661*b* are disposed in the one end portion side 610*a* of the substrate beyond the heat generating element 620 with gaps of about 4 mm in the longitudinal direction of the substrate 610. As shown in FIG. 6, no insulation coating layer 680 is provided at the positions of the electrical contacts 641, 651, 661*a*, 661*b* on the substrate 610 so that the electrical contacts are exposed. The electrical contacts 641, 651, 661*a*, 661*b* are exposed on a region 610*a* which is projected beyond an edge of the belt 603 with respect to the longitudinal direction of the substrate 610. Therefore, the electrical contacts 641, 651, 661*a*, 661*b* are contactable to the connector 700 to establish electrical connection therewith.

When voltage is applied between the electrical contact 641 and the electrical contact 651 through the connection between the heater 600 and the connector 700, a potential difference is produced between the common electrode 642 (642*b*-642*f*) and the opposite electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. The heat generating elements 620*c*, 620*d*, 620*e*, 620*f*, 620*g*, 620*h*, 620*i* as a first heat generating region generate heat, respectively. When voltage is applied between the electrical contact 641 and the electrical contact 661*a* through the connection between the heater 600 and the connector 700, a potential difference is produced between the common electrode 642*a* and the opposite electrode 662*a*. Therefore, through the heat generating elements 620*a*, 620*b*, the currents flow along the longitudinal direction of the substrate 610, the directions of the currents through the adjacent heat generating elements being opposite to each other. The heat generating elements 620*a*, 620*b* as a second heat generating region adjacent the first heat generating region generate heat.

When voltage is applied between the electrical contact 641 and the electrical contact 661*b* through the connection between the heater 600 and the connector 700, a potential difference is produced between the common electrode 642*f* and the opposite electrode 662*b* through the common electroconductive line 640 and the opposite electroconductive line 660*b*. Therefore, through the heat generating elements 620*k*, 620*l*, the currents flow along the longitudinal direction of the substrate 610, the directions of the currents through the adjacent heat generating elements being opposite to each other. By this, the heat generating elements 620*k*, 620*l* as a third heat generating region adjacent to the first heat generating region generate heat.

In this manner, on the heater 600, a part of the heat generating elements 620 can be selectively energized.

Between the one end portion side 610*a* of the substrate and the other end portion side 610*c*, there is a middle region 610*b*. More particularly, in this embodiment, the region between the common electrode 642*a* and the electrical contact 651 is the middle region 610*b*. The middle region 610*b* is a marginal area for permitting mounting of the connector 700 to the heater 600 placed inside the belt 603. In this embodiment, the middle region is 26 mm. This is sufficiently larger than the distance required for insulating the common electrode 642*a* and the electrical contact from each other.

[Connector]

Figure 7:
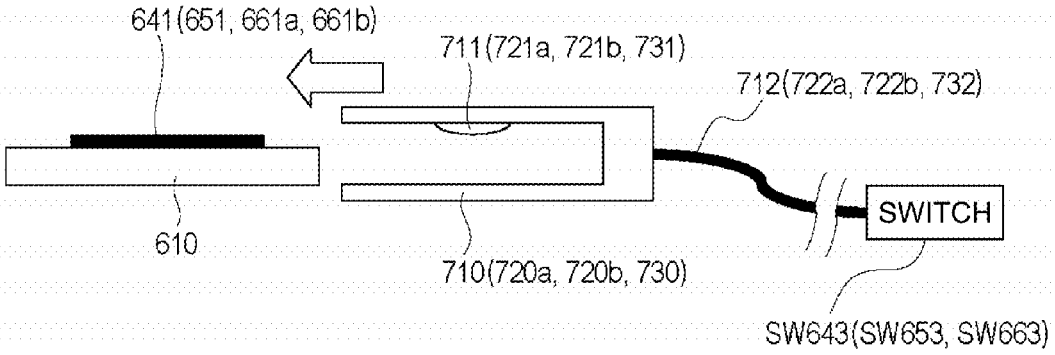
FIG. 7 illustrates a contact terminal.

The connector 700 used with the fixing device 40 will be described in detail. FIG. 7 is an illustration of a contact terminal 710. The connector 700 in this embodiment includes contact terminals 710, 720*a*, 720*b*, 730. The connector 700 is electrically connected with the heater 600 by mounting to the heater 600. The connector 700 comprises a contact terminal 710 electrically connectable with the electrical contact 641, and a contact terminal 730 electrically connectable with the electrical contact 651. The connector 700 also comprises a contact terminal 720*a* electrically connectable with the electrical contact 661*a*, and a contact terminal 720*b* electrically connectable with the electrical contact 661*b*. The connector 700 sandwiches a region of the heater 600 extending out of the belt 603 so as not to contact with the belt 603, by which the contact terminals are electrically connected with the electrical contacts, respectively. In the fixing device 40 of this embodiment having the above-described structures, no soldering or the like is used for the electrical connection between the connectors and the electrical contacts. Therefore, the electrical connection between the heater 600 and the connector 700 which rise in temperature during the fixing process operation can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 6, the connector 700 provided with the metal contact terminals 710, 720*a*, 720*b*, 730 is mounted to the heater 600 in the widthwise direction of the substrate 610 at one end portion side 610*a* of the substrate. The contact terminals 710, 720*a*, 720*b*, 730 will be described, taking the contact terminal 710 for instance. As shown in FIG. 8, the contact terminal 710 functions to electrically connect the electrical contact 641 to a switch SW643 which will be described hereinafter. The contact terminal 710 is provided with a cable 712 for the electrical connection between the switch SW643 and the electrical contact 711 for contacting to the electrical contact 641. The connector 700 includes a housing 750 (FIG. 6) for integrally holding the contact terminals 710, 720*a*, 720*b*, 730. The contact terminal 710 has a channel-like configuration, and by moving in the direction indicated by an arrow in FIG. 7, it can receive the heater 600. The portion of the contact terminal 710 which contacts the electrical contact 641 is provided with the electrical contact 711 which contacts the electrical contact 641, by which the electrical connection is established between the electrical contact 641 and the contact terminal 710. The electrical contact 711 has a leaf spring property, and therefore, contacts the electrical contact 641 while pressing against it. Therefore, the contact 710 sandwiches the heater 600 between the front and back sides to fix the position of the heater 600.

Similarly, the contact terminal 720*a* functions to contact the electrical contact 661*a* with the switch SW663 which will be described hereinafter. The contact terminal 720*a* is provided with the electrical contact 721*a* for connection to the electrical contact 661*a* and a cable 722*a* for connection to the switch SW663.

Similarly, the contact terminal 720*b* functions to contact the electrical contact 661*b* with the switch SW663 which will be described hereinafter. The contact terminal 720*b* is provided with the electrical contact 721*b* for connection to the electrical contact 661*b* and a cable 722*b* for connection to the switch SW663.

Similarly, the contact terminal 730 functions to contact the electrical contact 651 with the switch SW653 which will be described hereinafter. The contact terminal 730 is provided with the electrical contact 731 for connection to the electrical contact 651 and a cable 732 for connection to the switch SW653.

As shown in FIG. 6, the contact terminals 710, 720*a*, 720*b*, 730 composed of metal are integrally supported on the housing 750 of resin material. The contact terminals 710, 720*a*, 720*b*, 730 are provided in the housing 750 with spaces between adjacent ones so as to be connected with the electrical contacts 641, 661*a*, 661*b*, 651, respectively when the connector 700 is mounted to the heater 600. Between adjacent contact terminals, partitions are provided to electrically insulate between the adjacent contact terminals.

In this embodiment, the connector 700 is mounted in the widthwise direction of the substrate 610, but this mounting method is not limiting to the present invention. For example, the structure may be such that the connector 700 is mounted in the longitudinal direction of the substrate.

[Electric Energy Supply to Heater]

An electric energy supply method to the heater 600 will be described. The fixing device 40 of this embodiment is capable of changing the width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extend from the center portion. The electric energy supply to the heater 600 will be described in conjunction with the accompanying drawings.

The voltage source 110 is a circuit for supplying the electric power to the heater 600. In this embodiment, the commercial voltage source (AC voltage source) of 100V in effective value (single phase AC) is used. The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW653 connects or disconnects between the voltage source contact 110*b* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*b* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the voltage source 110, switch SW643, switch SW653, switch SW663 and the connector 700 functions as an electric energy supplying means for supplying the electric power to the heater 600.

When the sheet P is a large size sheet (an introducible maximum width size broader than a predetermined width size), that is, when an A3 size sheet is fed in the longitudinal direction or when the A4 size is fed in the landscape fashion, the width of the sheet P is 297 mm. Therefore, the control circuit 100 controls the electric power supply to provide the heat generation width B (FIG. 5) of the heat generating element 620. To effect this, the control circuit 100 renders ON all of the switch SW643, switch SW653, switch SW663. As a result, the heater 600 is supplied with the electric power through the electrical contacts 641, 661*a*, 661*b*, 651, so that all of the 12 sub-sections of the heat generating element 620 generate heat. At this time, the heater 600 generates the heat uniformly over the 320 mm region to meet the 297 mm sheet P.

When the size of the sheet P is a small size (a width size narrower than the introducible maximum width size), that is, when an A4 size sheet is fed longitudinally, or when an A5 size sheet is fed in the landscape fashion, the width of the sheet P is 210 mm. Therefore, the control circuit 100 provides a heat generation width A (FIG. 5) of the heat generating element 620. Therefore, the control circuit 100 renders ON the switch SW643, switch SW653 and renders OFF the switch SW663. As a result, the heater 600 is supplied with the electric power through the electrical contacts 641, 651, only 8 sub-sections of the 12 heat generating element 620 generate heat. At this time, the heater 600 generates the heat uniformly over the 213 mm region to meet the 210 mm sheet P.

[Heater Layer Step]

Figure 11:
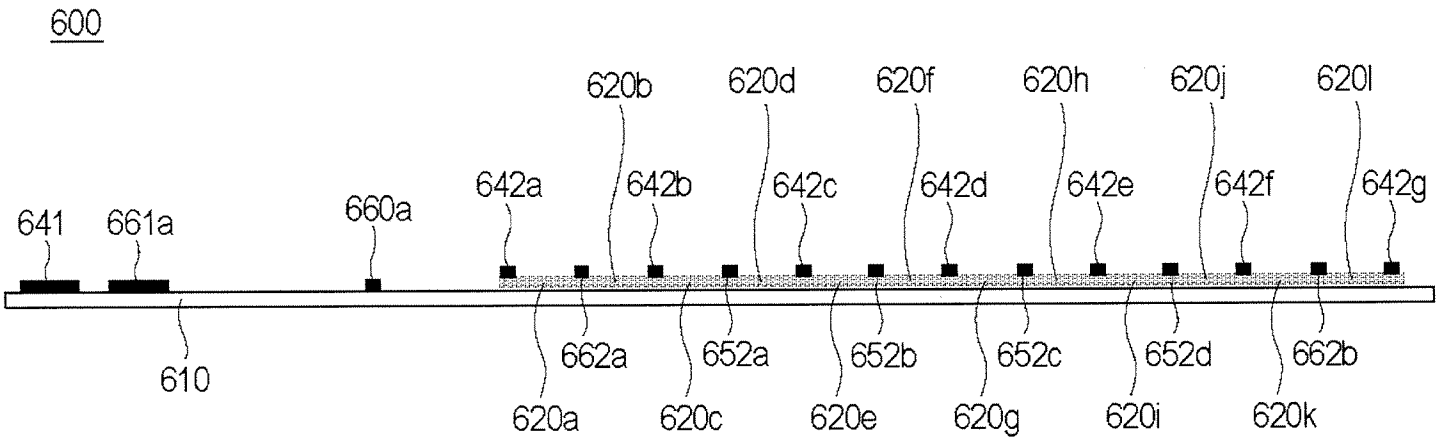
Fig. 11 PRIOR ART
FIG. 11 is a sectional view of a heater in a conventional example.
Figure 15:
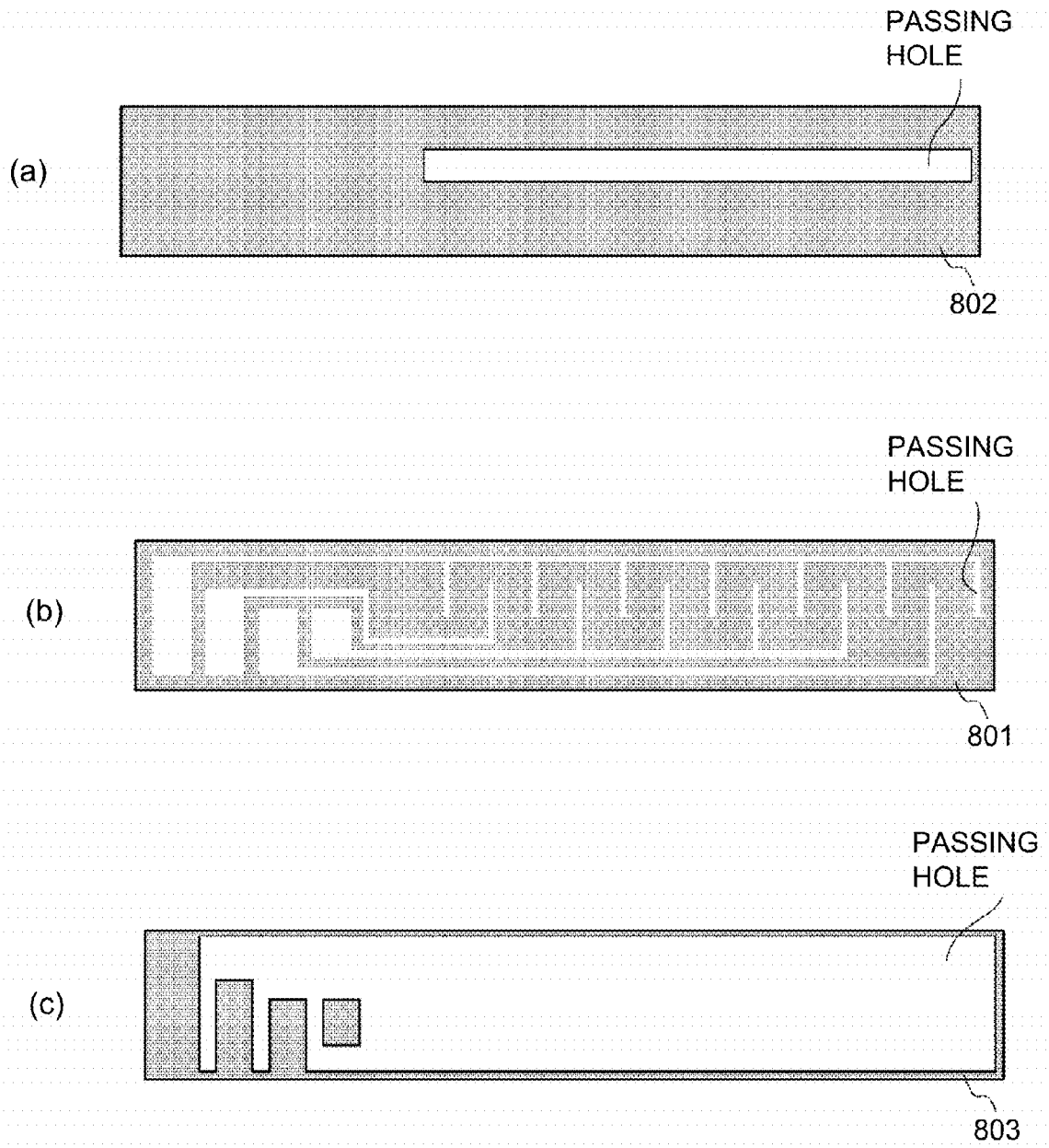
In FIG. 15, (*a*) is a schematic view showing a structure of a plate for heat generating element printing, (*b*) is a schematic view showing a structure of a plate for an electroconductor pattern printing, and (*c*) is a schematic view showing a structure of a plate for insulating coat layer printing.
Figure 16:
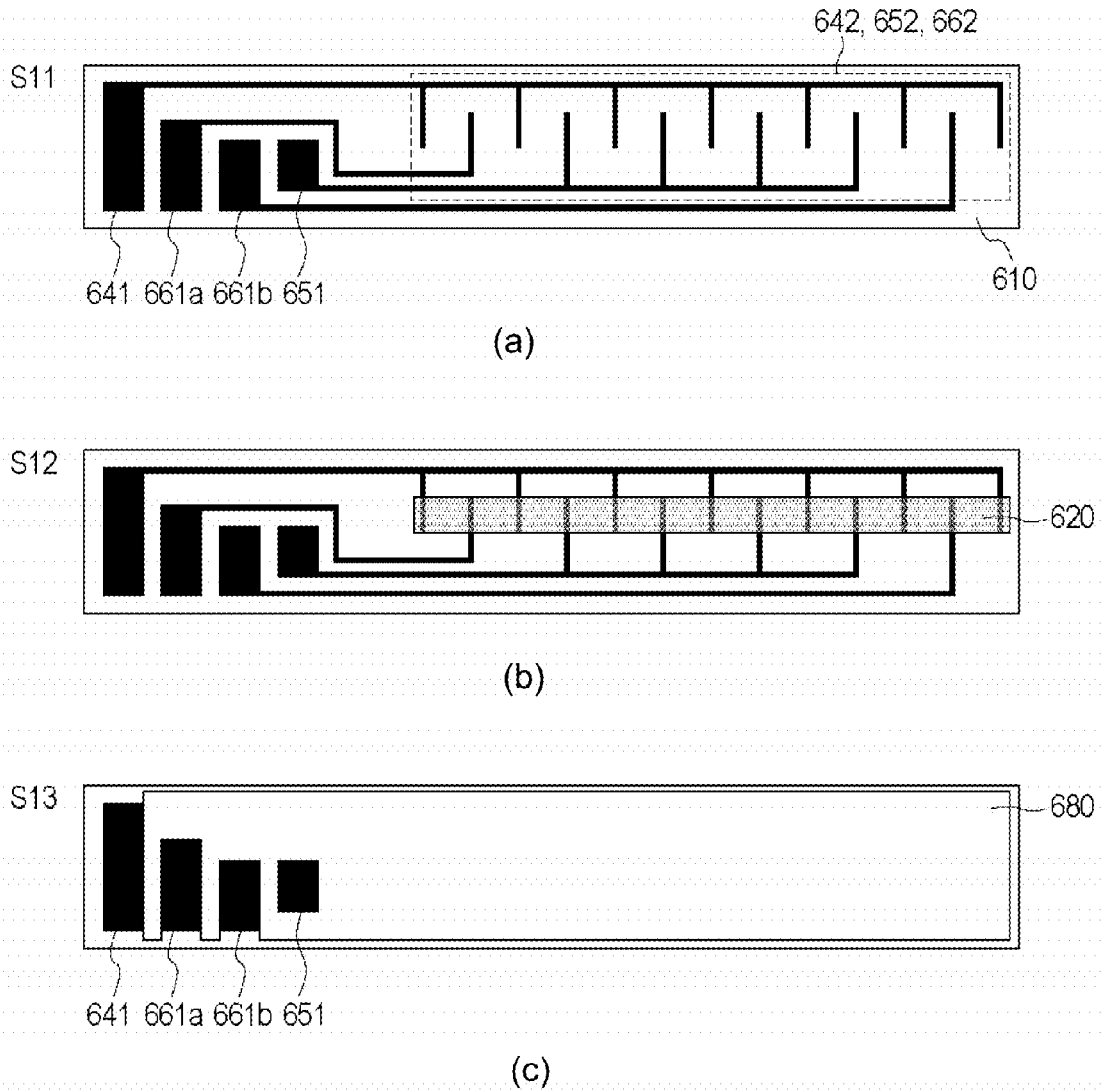
In FIG. 16, (*a*) to (*c*) are schematic views for illustrating manufacturing steps of the heater in Embodiment 1.
Figure 18:
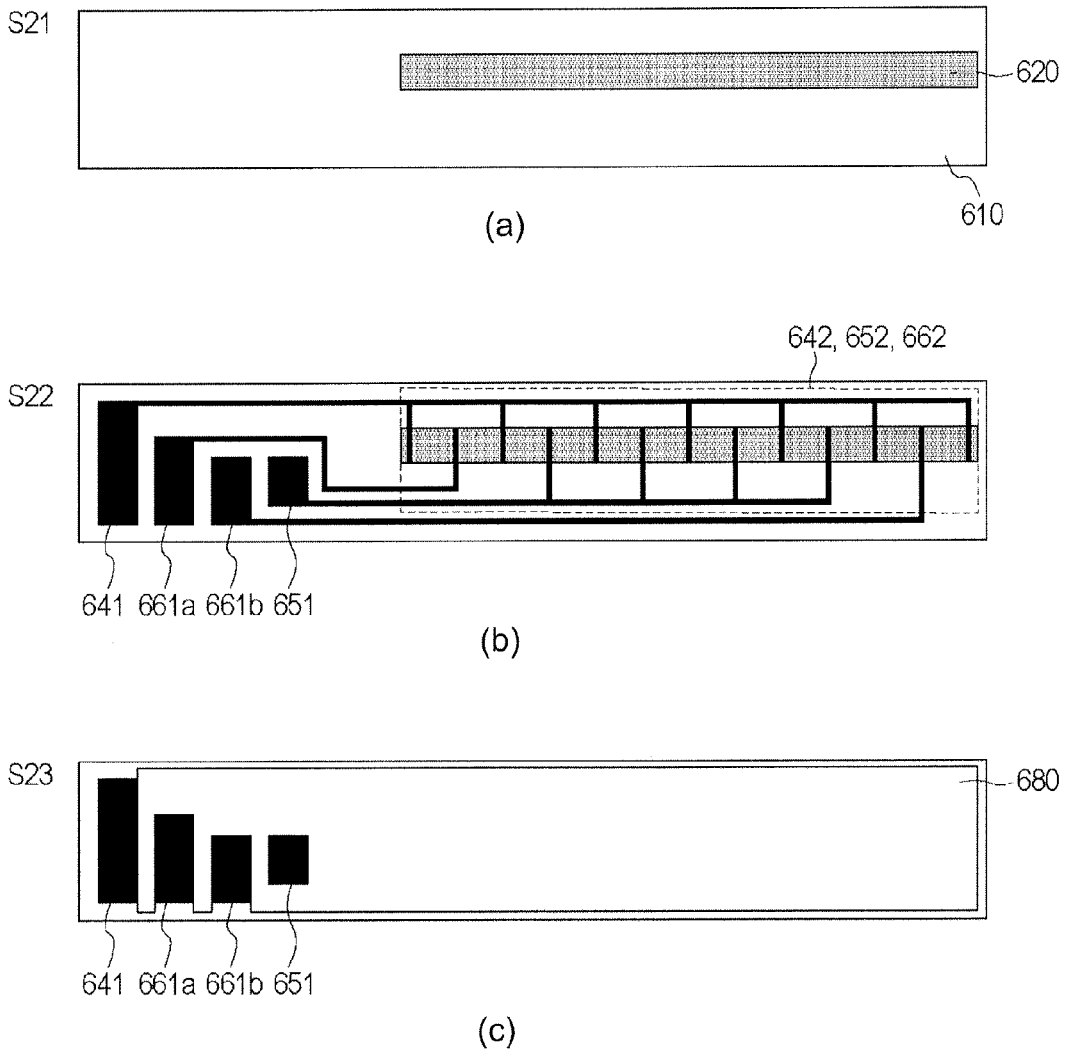
Fig. 18 PRIOR ART
In FIG. 18, (*a*) to (*c*) are schematic views for illustrating manufacturing steps of the heater in the conventional example.

A layer structure of the heater 600 will be described. FIG. 9 is a sectional view, taken along A-A line (FIG. 4) of the heater 600 in Embodiment 1. FIG. 11 is a sectional view, taken along A-A line (FIG. 4) of a heater 600 in a conventional example. In FIG. 15, (*a*) to (*c*) are schematic views each showing a plate used for screen printing. In FIG. 16, (*a*) to (*c*) are schematic views for illustrating manufacturing steps of the heater in Embodiment 1. In FIG. 18, (*a*) to (*c*) are schematic views for illustrating manufacturing steps of the heater in the conventional example. In the heater 600 in this embodiment, on the substrate 610, the electrodes 642, 652, 662 as the electrode layer are formed, and then the heat generating element 620 as the heat generating layer is formed so as to coat (cover) the electrodes. That is, in the heater 600 in this embodiment, the heat generating element 620 is contacted (connected) to an upper surface and widthwise side surfaces of each of the electrodes 642, 652, 662. In such a structure, in this embodiment, a current flowing from each of the electrodes 642, 652, 662 is provided from concentrating at a part of the heat generating element. Accordingly, in the heater 600 in this embodiment, generation of local abnormal temperature rise of the heat generating element 620 due to the current concentration is suppressed. In the following, this will be described using the drawings.

First, a manufacturing method of a ceramic heater using a thick film printing method (screen printing method) will be described.

In a step of subjecting the substrate 610 to the screen printing, a plate (mesh plate, metal mask plate, as shown in (*a*) to (*c*) of FIG. 15. A plate 801 ((*b*) of FIG. 15) is a member for printing, on the substrate, an electroconductor pattern including the electrodes 642, 652, 662. The plate 801 is provided with a passing hole through which a material paste is passable so that the electroconductor pattern is printed in a desired shape. A plate 802 ((*a*) of FIG. 15) is a member for printing the heat generating element 620 on the substrate. The plate 802 is provided with a passing hole through which a material paste is passable so that the heat generating element 620 is printed in a desired shape. A plate 803 ((*c*) of FIG. 15) is a member for printing the coat layer 680 on the substrate. The plate 803 is provided with a passing hole through which a material paste is passable so that the coat layer 680 is printed in a desired shape.

In the conventional example, the heater is manufactured by a procedure as shown in FIG. 18. First, the heat generating element 620 is formed on the substrate 610 (S21) ((*a*) of FIG. 18). Specifically, the substrate 610 and the plate 802 are (positionally) aligned with each other, and thereafter a paste of silver-palladium alloy is applied onto the substrate 610 through the plate 802. Thus, the heat generating element 620 having a desired dimension is printed on the substrate 610. Thereafter, the substrate 610 on which the heat generating element 620 is placed is baked at high temperature. Then, on the substrate 610 on which the heat generating element 620 is formed, an electroconductor pattern (electrode, electroconductive wire) of a silver paste is formed (S22) ((*b*) of FIG. 18). Specifically, after alignment between the substrate 610 and the plate 801 is made, the silver paste is applied onto the substrate 610 through the plate 801. Thus, the electroconductor pattern having a desired shape is printed on the substrate 610. Thereafter, the substrate 610 on which the heat generating element 620 and the electroconductor pattern are placed is baked at high temperature. Then, on the substrate 610 on which the electroconductor pattern and the heat generating element are placed, an insulating coat layer 680 for effecting electrical, mechanical and chemical protection is formed (S23) ((*c*) of FIG. 18). Specifically, after alignment between the substrate 610 and the plate 803, a glass paste is applied onto the substrate 610 through the plate 803. Thus, a desired coat layer 680 is printed on the substrate 610. Thereafter, the substrate 610 on which the heat generating element 620, the electroconductor pattern and the coat layer 680 are placed is baked at high temperature.

A cross-section, taken along A-A line (FIG. 4), of the heater 600 manufactured in the above-described manner in the conventional example is shown in FIG. 11. In FIG. 11, the coat layer 680 is omitted from illustration. As shown in FIG. 11, in the heater 600 in the conventional example, the electrodes 642, 652, 662 are laminated on the heat generating element 620, and therefore only lower surfaces of the electrodes 642, 652, 662 contact the heat generating element 620. In this embodiment, each of the electrodes is 10 μm in width and 2 mm in length. That is, an area of contact (connection) of one electrode with the heat generating element 620 is 0.2 $mm^2$ which is an area of each of the lower surfaces of the electrodes.

In such a heater 600, in the case where a voltage is applied between adjacent electrodes, a current concentratedly flows through a portion, of the heat generating element 620, adjacent to lower surface end portions of the electrodes. Then, the heat generating element 620 locally causes abnormal heat generation, so that deterioration is accelerated. For that reason, there was a risk that the connecting portion of the heat generating element 620 peels off from the electrodes.

Therefore, in this embodiment, the heater 600 is manufactured by a procedure as shown in FIG. 16. First, on the substrate 610, an electroconductor pattern (electrode, electroconductive wire) of a silver paste is formed (S11) ((*a*) of FIG. 16). Specifically, after alignment between the substrate 610 and the plate 801 is made, the silver paste is applied onto the substrate 610 through the plate 801. Thus, the electroconductor pattern having a desired shape is printed on the substrate 610. Thereafter, the substrate 610 on which the heat generating element 620 and the electroconductor pattern is placed is baked at high temperature.

Then, the heat generating element 620 is formed on the substrate 610 so as to coat (cover) the electrodes 642, 652, 662 (S12) ((*b*) of FIG. 16). Specifically, after alignment between the substrate 610 and the plate 802, a paste of silver-palladium alloy is applied onto the substrate 610 through the plate 802. Thus, the heat generating element 620 having a desired dimension is printed on the substrate 610. Thereafter, the substrate 610 on which the electroconductor pattern and the heat generating element 620 are placed is baked at a high temperature.

Then, on the substrate 610 on which the electroconductor pattern and the heat generating element are placed, an insulating coat layer 680 for effecting electrical, mechanical and chemical protection is formed (S13) ((*c*) of FIG. 16). Specifically, after alignment between the substrate 610 and the plate 803, a glass paste is applied onto the substrate 610 through the plate 803. Thus, the coat layer 680 having a desired shape is printed on the substrate 610. Thereafter, the substrate 610 on which the heat generating element 620, the electroconductor pattern and the coat layer 680 are placed is baked at a high temperature.

A cross-section, taken along A-A line (FIG. 4), of the heater 600 manufactured in the above-described manner in this embodiment is shown in FIG. 9. In FIG. 9, the coat layer 680 is omitted from illustration. As shown in FIG. 9, in the heater 600 in this embodiment, the heat generating element 620 is laminated on the electrodes 642, 652, 662, and therefore the electrodes 642, 652, 662 are covered with the heat generating element 620. That is, in this embodiment, the heat generating element 620 contacts (connects with) an upper surface (upper end portion surface (FIG. 9)) of each electrode and both side surfaces (left and right end portion surfaces (FIG. 9)) of each electrode. In this embodiment, each of the electrodes is 10 μm in width and 2 mm in length. That is, an area of contact of one electrode with the heat generating element 620 is 0.24 $mm^2$, which is the sum of an area of 0.2 $mm^2$ for each of the upper surfaces of the electrodes and an area of 0.02 $mm^2 \times 2$ for the both side surfaces of each of the electrodes.

In such a heater 600, in the case where a voltage is applied between adjacent electrodes, a current principally flows through the heat generating element 620 from an entire region of the electrode side surfaces providing a minimum current path, and in addition, the current flows through the heat generating element 620 from the electrode upper surface. That is, in this embodiment, current concentration at the connecting portion between the heat generating element 620 and the electrodes is suppressed. For that reason, in the heat generating element 620 in this embodiment, the local abnormal heat generation is suppressed, so that deterioration is suppressed. For that reason, compared with the conventional example, the risk that the connecting portion between the heat generating element and the electrodes is peeled off is low.

Further, as in the conventional example, in the method in which the electrodes are laminated on the heat generating element, in the case where the substrate 610 is formed of AlN (aluminum nitride) and a paste obtained by mixing a material for the heat generating element 620 with ruthenium oxide and glass particles is used, the following problem can occur. The problem is such that air bubbles generated between the electrodes and the heat generating element during the baking of the electrodes and then these manufactures are peeled off from each other. However, as in this embodiment, in the method in which the heat generating element is laminated on the electrodes, such a problem does not occur.

Further, in the heater 600 in the conventional example, after the manufacturing step S21, the printing non-uniformity of the heat generating element 620 is checked by measuring the resistance of the heat generating element 620 at a plurality of positions to check the resistance distribution. By performing this checking step, it is possible to manufacture the heater 600 for which a temperature distribution during energization is stabilized (i.e., temperature non-uniformity is suppressed). However, with respect to the heater 600 in this embodiment, the electroconductor pattern printing step S11 is performed before the step S11 of printing the heat generating element 620, and therefore it is difficult to measure the resistance distribution of the heat generating element 620. Therefore, in this embodiment, a checking step using a thermocamera is performed. Specifically, energization to the manufactured heater 600 is made, so that the heater 600 is heated to 200° C. Then, the temperature distribution is measured using the thermocamera, so that the state in which there is no difference of 5° C. or more between a minimum temperature and a maximum temperature is checked. By performing such a checking step, also in this embodiment, it is possible to manufacture the heater 600 with the stabilized temperature distribution (i.e., the suppressed temperature non-uniformity). In the checking step in this embodiment, the thermocamera is used, but another method may also be used if the method is capable of measuring the temperature distribution of an entire longitudinal region of the heat generating element 620. For example, a method in which the heater 600 is scanned with a non-contact thermistor in the longitudinal direction to detect a portion where abnormality in temperature may also be used.

Embodiment 2

Figure 10:
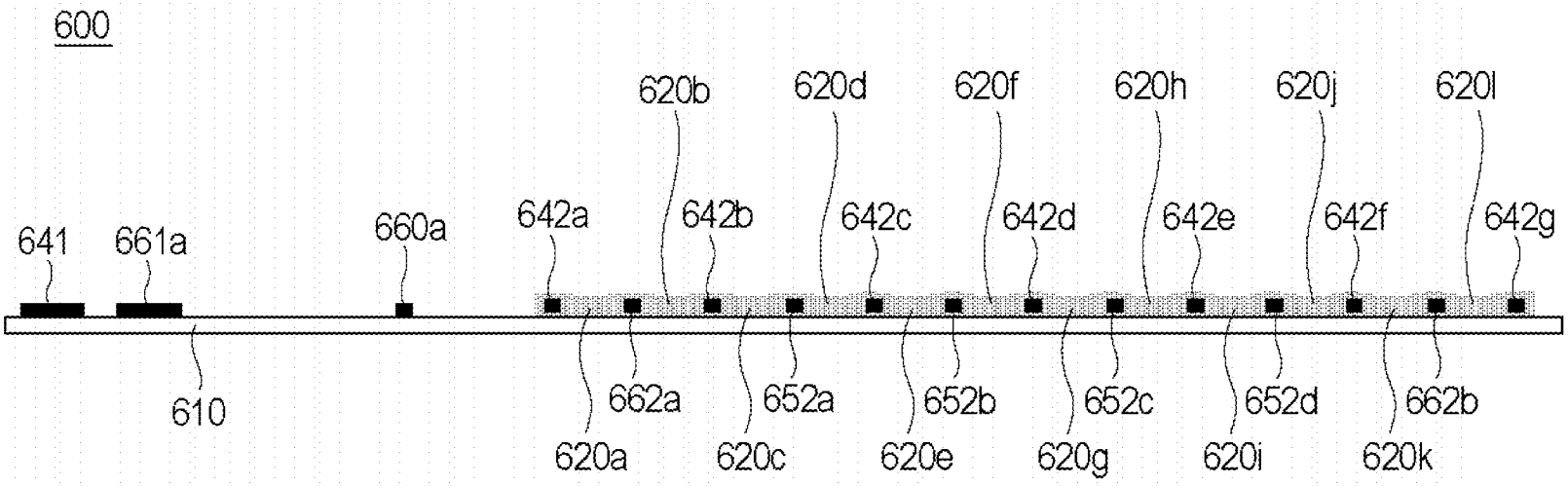
FIG. 10 is a sectional view of a heater in Embodiment 2.
Figure 17:
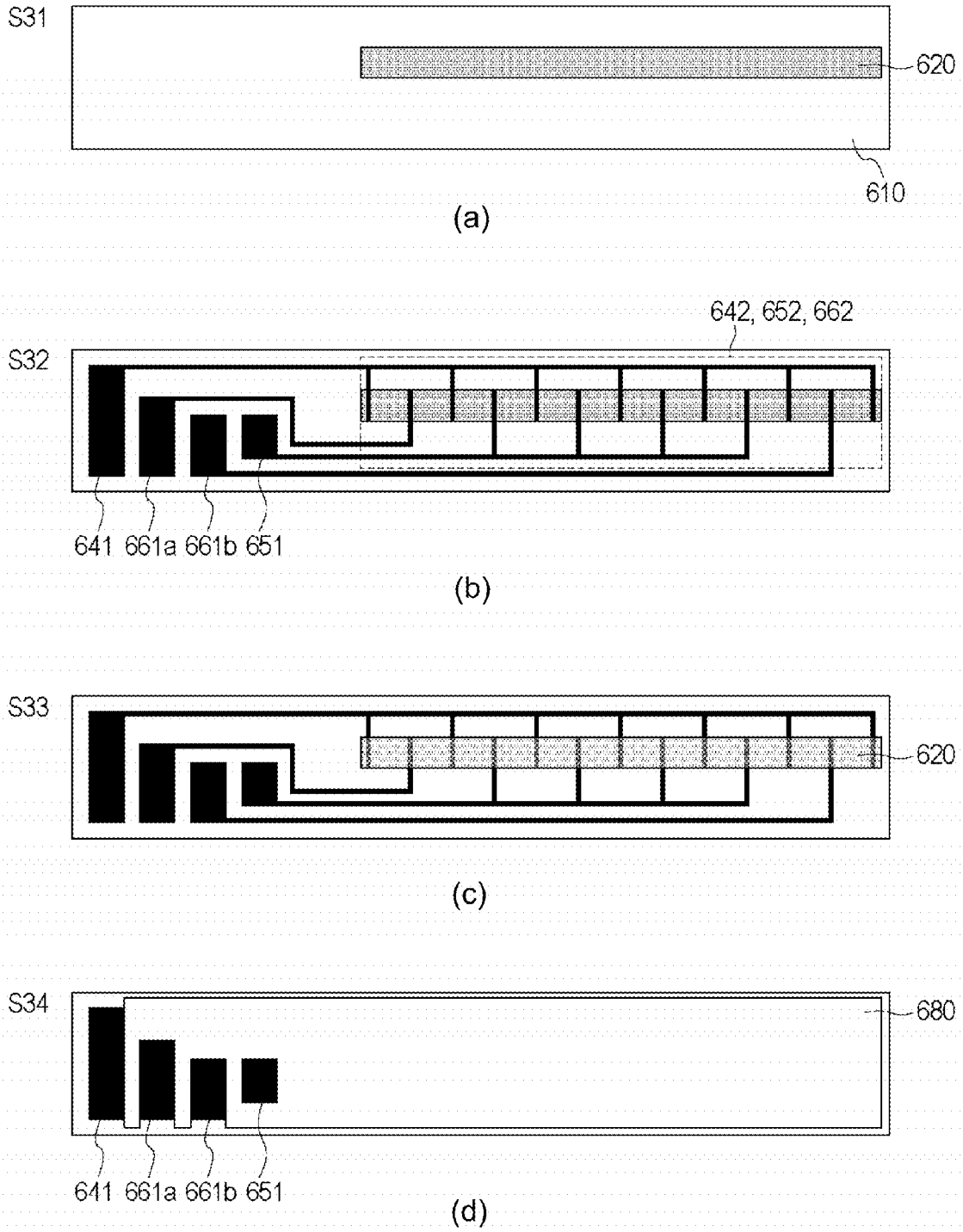
In FIG. 17, (*a*) to (*d*) are schematic views for illustrating manufacturing steps of the heater in Embodiment 2.

A heater 600 in Embodiment 2 will be described. FIG. 10 is a sectional view of the heater 600 in this embodiment. In FIG. 17, (*a*) to (*d*) are schematic views for illustrating manufacturing steps of the heater in this embodiment. In Embodiment 1, the heat generating element was laminated on the electrodes formed on the substrate. In this embodiment, the electrodes are provided on the heat generating element formed on the substrate, and thereon a heat generating element is further provided. In this embodiment, by employing such a layer structure of the heater 600 the contact area between the heat generating element and the electrodes is increased. This will be described hereinafter in detail. The constitution of the fixing device 40 in this embodiment is similar to the basic constitution in Embodiment 1 except for the constitution regarding the heater 600. For that reason, constituent elements similar to those in Embodiment 1 are represented by identical reference numerals or symbols and will be omitted from detailed description.

In the conventional example, the heater is manufactured by a procedure as shown in FIG. 17. First, the heat generating element 620 is formed as a lower layer on the substrate 610 (S31) ((*a*) of FIG. 17). Specifically, the substrate 610 and the plate 802 are (positionally) aligned with each other, and thereafter a paste of silver-palladium alloy is applied onto the substrate 610 through the plate 802. Thus, the heat generating element 620 (lower layer) having a desired dimension is printed on the substrate 610. The thickness of the heat generating element 620 as the lower layer at that time is 5 μm. Thereafter, the substrate 610 on which the heat generating element 620 (lower layer) is placed is baked at a high temperature.

Then, on the substrate 610 on which the heat generating element 620 is formed, an electroconductor pattern (electrode, electroconductive wire) of a silver paste is formed (S32) ((*b*) of FIG. 17). Specifically, after alignment between the substrate 610 and the plate 801 is made, the silver paste is applied onto the substrate 610 through the plate 801. Thus, the electroconductor pattern having a desired shape is printed on the substrate 610. Thereafter, the substrate 610 on which the heat generating element 620 and the electroconductor pattern are placed is baked at a high temperature.

Then, the heat generating element 620 is formed as an upper layer on the substrate 610 (S33) ((*c*) of FIG. 17). Specifically, after alignment between the substrate 610 and the plate 802, a paste of silver-palladium alloy is applied onto the substrate 610 through the plate 802. Thus, the heat generating element 620 (upper layer) having a desired dimension is printed on the substrate 610. The thickness of the heat generating element 620 as the upper layer at that time is 10 μm. Thereafter, the substrate 610 in which the electroconductor pattern and the heat generating element 620 (upper layer) are placed is baked at a high temperature.

Then, on the substrate 610 on which the electroconductor pattern and the heat generating element 620 are placed, an insulating coat layer 680 for effecting electrical, mechanical and chemical protection is formed (S34) ((*d*) of FIG. 17). Specifically, after alignment between the substrate 610 and the plate 803, a glass paste is applied onto the substrate 610 through the plate 803. Thus, the coat layer 680 having a desired shape is printed on the substrate 610. Thereafter, the substrate 610 on which the heat generating element 620, the electroconductor pattern and the coat layer 680 are places is baked at a high temperature.

A cross-section, taken along A-A line (FIG. 4), of the heater 600 manufactured in the above-described manner in this embodiment is shown in FIG. 10. In FIG. 10, the coat layer 680 is omitted from illustration. As shown in FIG. 10, in the heater 600 in this embodiment, a full circumference of the electrodes 642, 652, 662 is covered with the heat generating element 620, and therefore upper surfaces, lower surfaces and both side surfaces of the electrodes 642, 652, 662 contact the heat generating element 620. In this embodiment, each of the electrodes is 10 μm in width and 2 mm in length. That is, an area of contact of one electrode with the heat generating element 620 is 0.44 $mm^2$, which is the sum of an area of 0.2 $mm^2$ for each of the lower surfaces of the electrodes, 0.2 $mm^2$ for each of the upper surfaces of the electrodes and an area of 0.02 $mm^2 \times 2$ for the both side surfaces of each of the electrodes.

In the case where a voltage is applied between adjacent electrodes, a current principally flows through the heat generating element 620 from an entire region of the electrode side surfaces providing a minimum current path, and in addition, the current flows through the heat generating element 620 from the electrode upper and lower surface. That is, in this embodiment, current concentration at the connecting portion between each of the heat generating elements 620 and the electrodes is suppressed. For that reason, in each of the heat generating elements 620 in this embodiment, the local abnormal heat generation is suppressed, so that deterioration is suppressed. For that reason, compared with the conventional example, the risk that the connecting portion between each of the heat generating elements and the electrodes is peeled off is low.

(Current Density Simulation)

Figure 12:
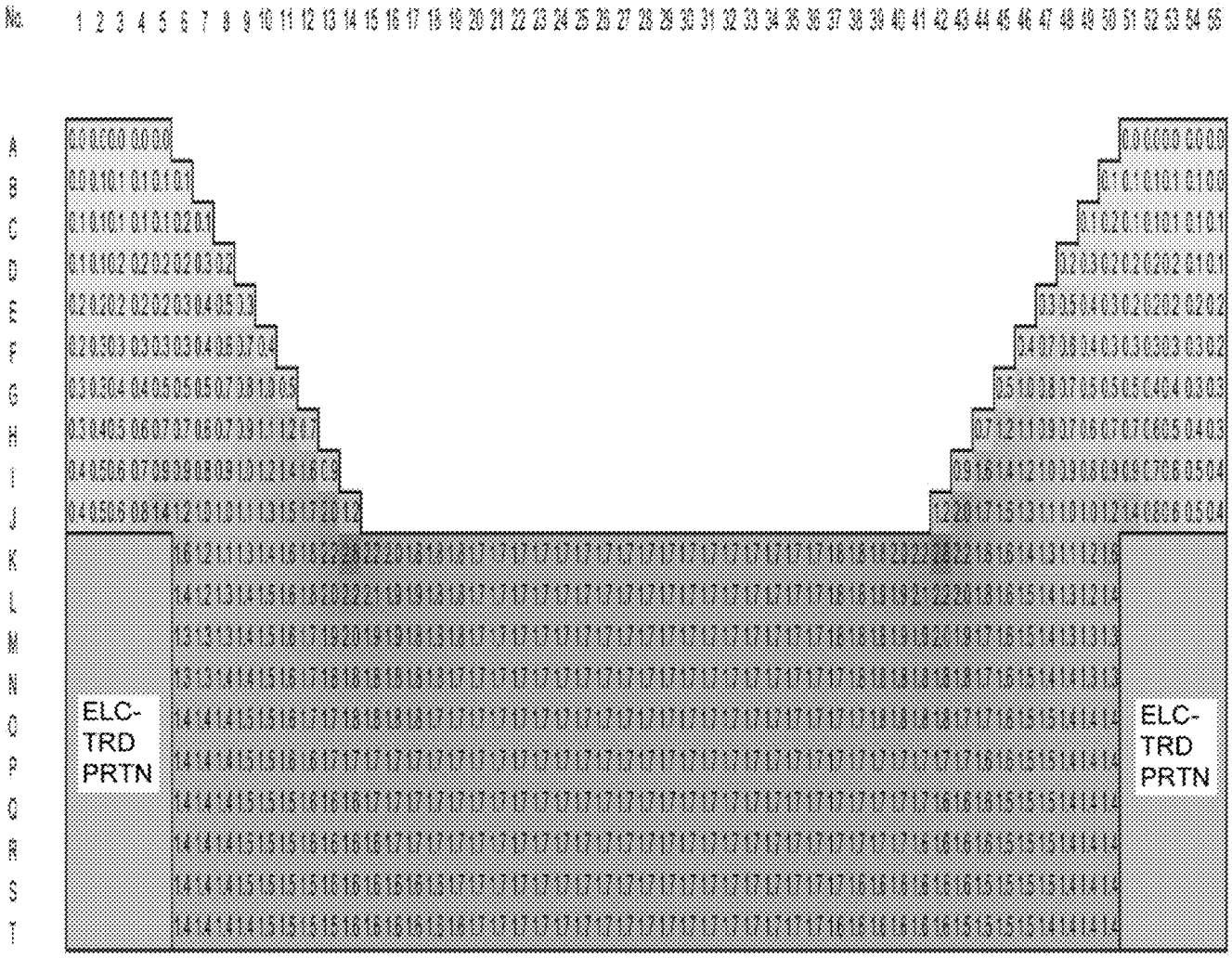
FIG. 12 is a schematic view showing a simulation result of the heater in Embodiment 1.
Figure 13:
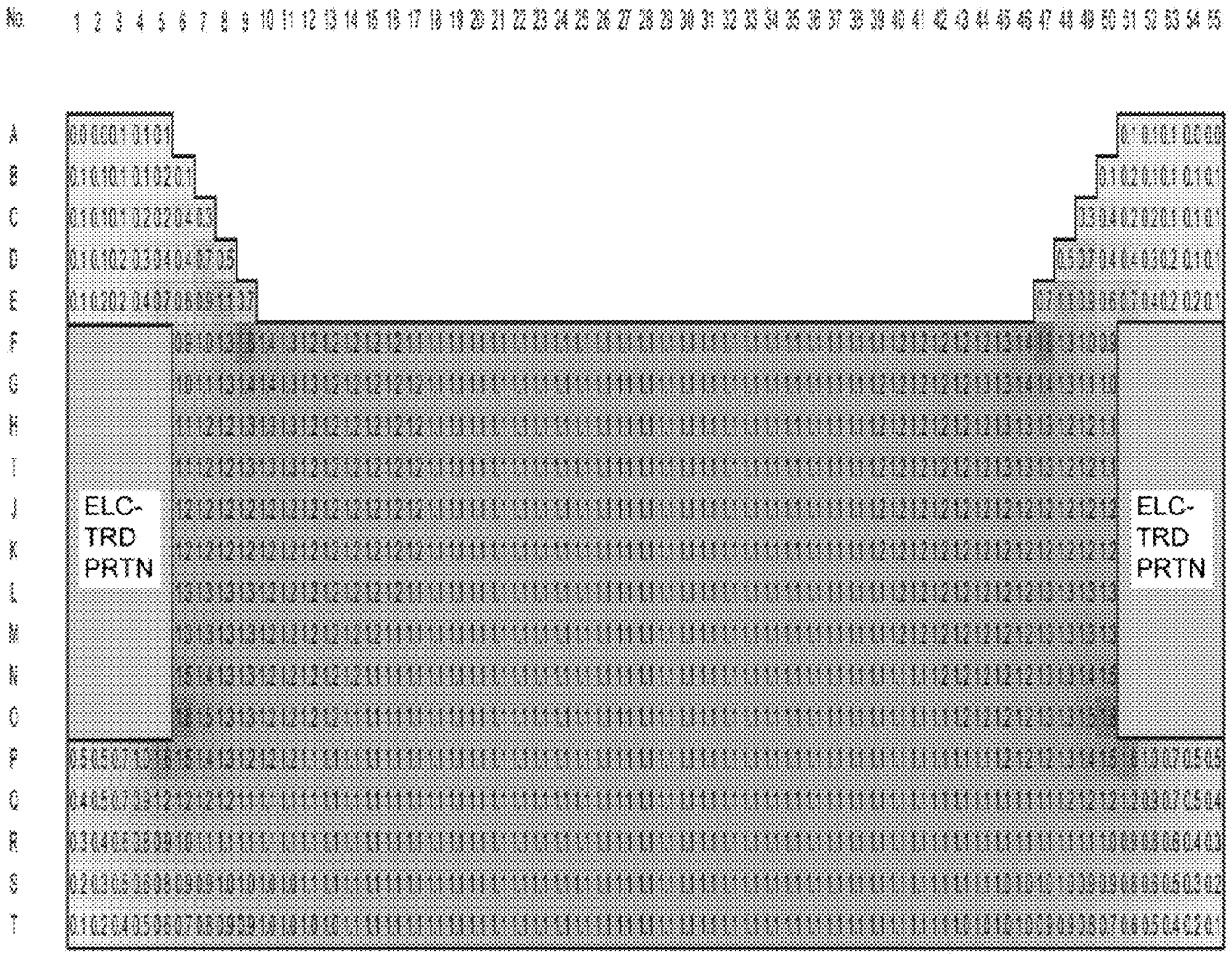
FIG. 13 is a schematic view showing a simulation result of the heater in Embodiment 2.
Figure 14:
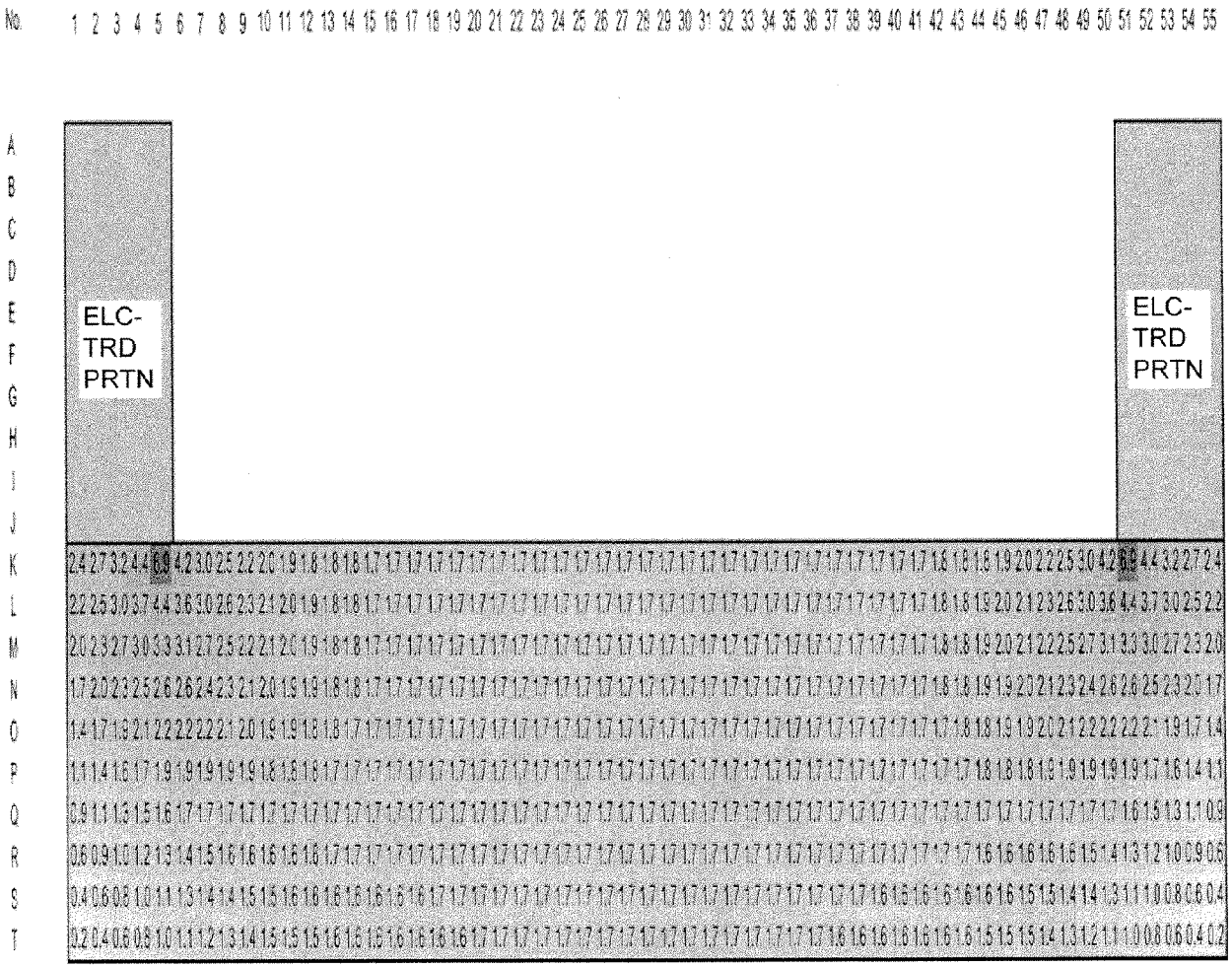
PRIOR ART Fig. 14
FIG. 14 is a schematic view showing a simulation result of the heater in the conventional example.

In each of the heaters 600 in Embodiment 1, Embodiment 2 and the conventional example, the state of a distribution of the ease of a flow of the current through the heat generating element 620 was checked by simulation. FIG. 12 is a schematic view for illustrating the distribution of the ease of the heater current flow in Embodiment 1. FIG. 13 is a schematic view for illustrating the distribution of the heater current flow in Embodiment 2. FIG. 14 is a schematic view for illustrating the current density distribution of the heater in the conventional example.

The result of the simulation made in a state in which the electrodes (electrode portions) and the heat generating element are arranged by following a positional relationship between adjacent electrodes (e.g., the electrodes 642*a* and 662*a*) arranged with a gap in the cross-section taken along the A-A line (FIG. 4) of the heater 600 is shown in each of FIGS. 12 to 14. In this simulation, the heater 600 is divided into blocks, in which the ordinate ranges from A to T, and the abscissa ranges from 1 to 55. On the basis of potentials of the respective blocks, the potential difference between adjacent left and right blocks and the potential difference between adjacent upper and lower blocks are added up, so that the degree of the ease of the flow of the current through each of the blocks is calculated as a point. This degree of ease of the flow of the current correlates with the current density, so that a larger degree of each of current flow leads to a larger current density, and a smaller degree of the current flow leads to a smaller current density. That is, by checking the distribution of the degree of the ease of the current flow, it is possible to check the current density distribution.

In the simulation of the heater in the conventional example, a voltage of 60 V is applied between the left and right electrodes. In the simulation of the heater in Embodiment 1, a voltage of 36 V is applied between the electrodes so that the heat generation amount of the heat generating element between the electrodes is similar to that in the simulation of the heater in the conventional example. In the simulation of the heater in Embodiment 2, a voltage of 26 V is applied between the electrodes so that the heat generation amount of the heat generation element between the electrodes is similar to that in the simulation of the heater in the conventional example.

The difference among these applied voltages results from a difference in resistance of the heat generating element generated due to a difference in manner of lamination of the electrodes and the heat generating element.

In each of the simulations, a result of parameters of the blocks where the current density becomes high is shown in Table 1.

TABLE 1

| | BET*1 (V) | ECF (HGE)*2 | ECF (CP)*3 |
|---|---|---|---|
| C.E.*4 | 50 | 6.89 | 6.89 |
| EMB. 1 | 36 | 2.80 | 1.57 |
| EMB. 2 | 26 | 1.83 | 1.83 |

*1"VBE" is the voltage applied between the electrodes.
*2"ECF (HGE)" is a maximum (largest) degree of ease of the current flow through the heat generating element.
*3"ECF (CP)" is a maximum degree of ease of the current flow through the connecting portion.
*4"CE" is the conventional example.

As shown in FIG. 14, in the simulation in the conventional example, at a block of K in the ordinate and 5 in the abscissa (hereinafter referred to as a block K5) and a block K51, the largest degree of the current flow is shown. Each of K5 and K51 is one of the associated blocks (K1 to K5) or (K51 to K55) at the connecting portions of the heat generating element 620 with the electrodes. Further, according to FIG. 14, it is understood that the current concentrates at the periphery of the blocks (K1 to K51) positioned in the shortest path connecting the left and right electrodes. At this time, the degree of ease of the current flow at each of the blocks K1 and K51 is 6.89 (about 6.9). Here, as a place where the current density is stabilized, a value of the blocks at the position of 28 in the abscissa remote from the left and right electrodes is taken as a reference. The degree (6.89) of the ease of the current flow at K5 and K51 is about 4 times the degree (1.7) of the ease of the current flow at the blocks of the position of 28 in the abscissa.

In the simulation in Embodiment 1, as shown in FIG. 12, of all the blocks of the heat generating element, the maximum degree of the ease of the current flow is shown at the blocks K14 and K42. A value thereof is 2.80, which is about 1.6 times the degree (1.7) of the ease of the current flow at the blocks of the position of 28 in the abscissa.

Of the blocks (J1 to J6, J50 to J55, K6 to T6, K50 to T50) at the connecting portions adjacent to the left and right electrodes of the heat generating element, the maximum degree of the ease of the current flow is shown at the blocks K6 and K50. A value thereof is 1.57, which is about 0.9 times the degree (1.7) of the ease of the current flow at the blocks of the position of 28 in the abscissa.

In the simulation in Embodiment 2, as shown in FIG. 13, of all the blocks of the heat generating element, the maximum degree of the ease of the current flow is shown at the blocks O6, O50, F9 and F47. This is similarly understood also in the case of a comparison among the blocks (E1 to E6, E50 to E55, P1 to P6, P50 to P55, F6 to O6, F50 to O50) of the connecting portions of the heat generating element adjacent to the left and right electrodes. The value thereof is 1.83 (about 1.8), which is about 1.6 times the degree (1.1) of the ease of the current flow at the blocks of the position of 28 in the abscissa.

From the above results, it was understood that in Embodiments 1 and 2, the current concentration is alleviated compared with the conventional example. Particularly, it was understood that in Embodiments 1 and 2, the current concentration is alleviated at the connecting portion of the heat generating element with the electrodes.

(Heat Cycle Test)

A heat cycle test was conducted using ten heaters in each of embodiment 1, Embodiment 2 and the conventional example. In this test, each heater is caused to generate heat by being energized so that the heater temperature becomes 250° C., and the heater is cooled to 50° C. (one cycle). This cycle was repeated $300\times10^3$ times. A result is shown in Table 2.

TABLE 2

| | OK*1 | NG*2 |
|---|---|---|
| CE*3 | 8 | 2 |
| EMB. 1 | 10 | 0 |
| EMB. 2 | 10 | 0 |

*1"OK" is the number of heaters capable of achieving the heat cycle of $300 \times 10^3$ times.
*2"NG" is the number of heaters incapable of achieving the heat cycle of $300 \times 10^3$ times.
*3"CE" is the conventional example.

As shown in Table 2, in the conventional example, of the 10 heaters, 2 heaters were incapable of achieving the heat cycle of $300\times10^3$ times. Of the 2 heaters, one heater generated partial peeling off at the connecting portion between the common electrode 642*g* and the heat generating element 620*l* at the time of the heat cycle of $270\times10^3$ times, and the other heater generated partial peeling-off at the connecting portion between the opposite electrode 662*a* and the heat generating element 620*b* at the time of the heat cycle of $250\times10^3$ times. On the other hand, in each of Embodiments 1 and 2, all of the 10 heaters were capable of achieving the heat cycle of $300\times10^3$ times.

As described above, with respect to the heater 600 in each of Embodiments 1 and 2, the common electrode 642 and the opposite electrodes 652 and 662 are covered with the heat generating element 620. The spaces each between the adjacent electrodes are filled with the heat generating element 620. For that reason, it is possible to connect, by the heat generating element, the shortest path connecting the adjacent electrodes. For that reason, the current flow does not readily generate a by-pass, so that the current concentration is not readily generated. The contact area between the electrodes and the heat generating element 620 is increased, so that the path of the current flowing from the electrodes to the heat generating element 620 is dispersed, and thus the current concentration is suppressed. For that reason, with respect to the heater 600 in each of Embodiments 1 and 2, the generation of local overheating of the heat generating element due to the current concentration is suppressed. Accordingly, according to Embodiments 1 and 2, thermal deterioration of the heater 600 due to local heat generation of the heat generating element 620 (particularly at the connecting portion of the heat generating element 620 with the electrode) can be suppressed, and therefore, it is possible to provide the heater having a long lifetime.

Other Embodiments

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples, which are based on the sheets P that are fed with the center thereof aligned with the center of the fixing device 40, but the sheets P may also be supplied on another sheet feeding basis of the fixing device 40. For that reason, e.g., in the case where the sheet feeding basis is an end(-line) feeding basis, the heat generating regions of the heater 600 may be modified so as to satisfy the condition in which the sheets are supplied with one end thereof aligned with an end of the fixing device. More particularly, the heat generating elements corresponding to the heat generating region A are not heat generating elements 620*c*-620*j*, but are heat generating elements 620*a*-620*e*. With such an arrangement, when the heat generating region is switched from that for a small size sheet to that for a large size sheet, the heat generating region does not expand at both of the opposite end portions, but expands at one of the opposite end portions.

The number of patterns of the heat generating region of the heater 600 is not limited to two. For example, three or more patterns may be provided.

The number of the electrical contacts limited to three or four. For example, five or more electrical contacts may also be provided depending on the number of heat generating patterns required for the fixing device.

Further, in the fixing device 40 in Embodiment 1, by the constitution in which all of the electrical contacts are disposed in one longitudinal end portion side of the substrate 610, the electric power is supplied from one end portion side to the heater 600, but the present invention is not limited to such a constitution. For example, a fixing device 40 having a constitution in which electrical contacts are disposed in a region extended from the other end of the substrate 610 and then the electric power is supplied to the heater 600 from both of the end portions may also be used.

The belt 603 is not limited to that supported by the heater 600 at the inner surface thereof and driven by the roller 70. For example, so-called belt unit type may be used, in which the belt is extended around a plurality of rollers and is driven by one of the rollers. However, the structures of Embodiments 1 and 2 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus, which has been a printer 1, is not limited to that capable of forming a full-color, but it may be a monochromatic image forming apparatus. The image forming apparatus may be a copying machine, a facsimile machine, a multifunction machine having the function of them, or the like, for example, which are prepared by adding the necessary device, equipment and casing structure.

The image heating apparatus is not limited to the apparatus for fixing a toner image on a sheet P. It may be a device for fixing a semi-fixed toner image into a completely fixed image, or a device for heating an already fixed image. Therefore, the image heating apparatus may be a surface heating apparatus for adjusting the glossiness and/or the surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-183707 filed on Sep. 9, 2014, which is hereby incorporated by reference herein in its entirety.

What is claimed is:

1. A heater connectable with an electric power supply portion having a first terminal and a second terminal, said heater comprising:

an elongate substrate;

a first electrical contact provided on said substrate and electrically connectable with the first terminal;

a plurality of second electrical contacts provided on said substrate and electrically connectable with the second terminal;

an electroconductive line extending in a longitudinal direction of said substrate and electrically connected with said first electrical contact;

a plurality of electrodes including first electrodes electrically connected with said first electrical contact through said electroconductive line and second electrodes electrically connected with said second electrical contacts, said first electrodes and said second electrodes being arranged alternately with predetermined gaps in the longitudinal direction; and a heat generating layer provided on said substrate so as to electrically connect between adjacent ones of said electrodes and to cover said electrodes and configured to generate heat by the electric power supply between adjacent electrodes.

2. A heater according to claim 1, wherein said first electrical contact and said second electrical contacts are all disposed in one end portion side of said substrate with respect to the longitudinal direction.

3. A heater according to claim 1, further comprising:

a first electroconductive line provided on said substrate and configured to electrically connect between one of said second electrical contacts and a part of said second electrodes; and a second electroconductive line provided on said substrate and configured to electrically connect between another one of said second electrical contacts and another part of said second electrodes.

4. An image heating apparatus comprising:

(i) an electric energy supplying portion provided with a first terminal and a second terminal;

(ii) a rotatable member configured to heat an image on a sheet; and (iii) a heater configured to heat said rotatable member, said heater including:

(iii-i) an elongate substrate;

(iii-ii) a first electrical contact provided on said substrate and electrically connectable with said first terminal;

(iii-iii) a plurality of second electrical contacts provided on said substrate and electrically connectable with said second terminal;

(iii-iv) an electroconductive line extending in a longitudinal direction of said substrate and electrically connected with said first electrical contact;

(iii-v) a plurality of electrodes including first electrodes electrically connected with said first electrical contact through said electroconductive line and second electrodes electrically connected with said second electrical contacts, said first electrodes and said second electrodes being arranged alternately with predetermined gaps in the longitudinal direction; and (iii-vi) a heat generating layer provided said substrate so as to electrically connect between adjacent ones of said electrodes and to cover said electrodes and configured to generate heat by the electric power supply between adjacent electrodes.

5. An image heating apparatus according to claim 4, wherein said electric energy supplying portion includes an AC circuit.

6. An image heating apparatus according to claim 4, wherein said first electrical contact and said second electrical contacts are all disposed in one end portion side of said substrate with respect to the longitudinal direction.

7. An image heating apparatus according to claim 4, wherein said heater includes, a first electroconductive line provided on said substrate and configured to electrically connect between one of said second electrical contacts and a part of said second electrodes; and a second electroconductive line provided on said substrate and configured to electrically connect between another of said second electrical contacts and another part of said second electrodes.

8. An image heating apparatus according to claim 4, wherein said electric energy supply portion supplies the electric energy to said first electrical contact and all of said second electrical contacts when the width of the sheet is wider than a predetermined width, and wherein said electric energy supply portion supplies the electrical energy to said first electrical contact and a part of said second electrical contacts when the width of the sheet is not wider than the predetermined width.

* * * * *